US009388561B2

(12) United States Patent
Johnson et al.

(10) Patent No.: US 9,388,561 B2
(45) Date of Patent: Jul. 12, 2016

(54) MODULAR CONSTRUCTION MOLD APPARATUS AND METHOD FOR CONSTRUCTING CONCRETE BUILDINGS AND STRUCTURES

(76) Inventors: Frank Johnson, Boston, MA (US); Minhaj Kirmani, Lexington, MA (US)

( * ) Notice: Subject to any disclaimer, the term of this patent is extended or adjusted under 35 U.S.C. 154(b) by 441 days.

(21) Appl. No.: 12/503,414

(22) Filed: Jul. 15, 2009

(65) Prior Publication Data

US 2011/0011018 A1 Jan. 20, 2011

(51) Int. Cl.
*E04B 1/16* (2006.01)
*E04B 1/14* (2006.01)
*E04B 2/86* (2006.01)

(52) U.S. Cl.
CPC . *E04B 1/161* (2013.01); *E04B 1/14* (2013.01); *E04B 2/8635* (2013.01); *E04B 2/8652* (2013.01); *E04B 2002/867* (2013.01)

(58) Field of Classification Search
CPC ..... E04B 2002/867; E04B 2/8635; E04B 2/8641; E04B 2/8652; E04B 1/161; E04B 2/8617; E04B 2/8647; E04G 17/14; E04G 17/12; E04G 17/02; E04G 17/04; E04G 11/087; E04C 5/168
USPC ..... 52/425, 426, 428, 422, 424, 433, 434, 52/436, 441, 250, 299, 653.1, 270, 271, 52/79.1, 79.14, 319, 332, 333; 249/26, 27, 249/219.1, 191, 192, 193, 194; 264/35
See application file for complete search history.

(56) References Cited

U.S. PATENT DOCUMENTS 4,147,322 A * 4/1979 Dahlstrom ..... 249/40
4,180,956 A * 1/1980 Gross ..... 52/407.1
4,557,091 A * 12/1985 Auer ..... 52/282.3
5,014,478 A * 5/1991 Spring ..... 52/281
5,038,541 A * 8/1991 Gibbar, Jr. ..... 52/295
5,588,268 A * 12/1996 Sterflinger ..... E04C 2/36 114/85
5,834,082 A * 11/1998 Day ..... 428/56
5,860,262 A * 1/1999 Johnson ..... 52/426
6,658,810 B2 * 12/2003 DeLoach, Sr. ..... 52/701
6,807,789 B1 * 10/2004 Kim et al. ..... 52/847
7,730,688 B2 * 6/2010 Pfeiffer ..... 52/426
7,765,765 B1 * 8/2010 Perronne ..... 52/742.14
2005/0016103 A1 * 1/2005 Piccone ..... 52/481.1
2007/0175155 A1 * 8/2007 Cymbala et al. ..... 52/562
2008/0229692 A1 * 9/2008 Crosby et al. ..... 52/426
2010/0132291 A1 * 6/2010 Lee ..... E04B 2/8635 52/341

* cited by examiner

*Primary Examiner* — Brian Glessner
*Assistant Examiner* — Omar Hijaz
(74) *Attorney, Agent, or Firm* — Burns & Levinson LLP

(57) ABSTRACT

A modular steel-framed construction mold apparatus comprised of a plurality of contiguous foundation, cavity wall and roof deck void spaces defined and formed by assemblies of interlocking encasement panels and connectors integrally attached to a structural steel grillage for accepting, containing, and shaping wet concrete fill, a method for forming, casting, and encasing monolithic composite concrete and steel buildings and structures in situ using said mold apparatus, and a permanently encased monolithic composite concrete and steel structure constructed by employing the foregoing modular mold apparatus and method of concrete construction. The structural steel grillage supports the encasement assemblies before and during the casting process, becoming fully embedded within the cast concrete, and provides tensile strength complementing the compressive strength of concrete fill. The panelized encasement assemblies remain in place following casting protecting and insulating the resulting composite concrete and steel buildings and structures.

10 Claims, 24 Drawing Sheets

6

MODULAR CONSTRUCTION MOLD APPARATUS AND METHOD FOR CONSTRUCTING CONCRETE BUILDINGS AND STRUCTURES

FIELD OF THE INVENTION

The present invention relates generally to the building arts, and more particularly to the means and methods of constructing large dimensioned monolithic composite concrete and steel buildings and structures underwater and on dry land.

BACKGROUND OF THE INVENTION

The present invention creates a new advance beyond the state of the art shown in U.S. Pat. No. 5,860,262 to Frank K. Johnson ("the '262 patent"), the disclosure which is incorporated herein by reference.

Corrosion plagues all reinforced concrete structures exposed to the elements after only a few years of service reducing the load bearing capacity of a structure and imposing heavy economic burdens on the community in order to maintain them in a safe and functionally operational condition.

Another, even more costly drawback stems from the manner in which reinforced concrete facilities are constructed. A temporary wood-sheathed structure, called formwork must be fabricated on site, erected, braced, shored and tied together in order to support, contain and shape wet concrete fill for a relatively small section of the structure being built. After casting, this formwork structure must remain in place for a period of time while the wet concrete cures before being removed, cleaned, repaired and then re-erected to cast another section. These labor intensive, time consuming tasks are repeated over and over again for each incremental unit of the structure until the last cubic yard of concrete has been cast.

Vertical formwork for constructing walls must be braced and tie rods fastened to the forms to prevent them from separating when the wet concrete fill is cast into the void space. Formwork supporting horizontal slabs must be shored from underneath and the shores and formwork left in place until the concrete has gained sufficient strength to support itself before they can be removed and reused to cast another incremental section of deck or floor slab.

Concurrently with erection of the formwork, another labor-intensive, time consuming and even more costly task is taking place: rebar installation. Typically, for walls, vertical rods are installed first, one at a time. One by one, horizontal rods are then attached to the installed verticals with wires hand twisted by workers supported on the steel cage they are erecting.

The industry has made strides in reducing costs of formwork and rebar installation when constructing high rise commercial and residential buildings. Common practice in the industry is to design a building's structural steel framework and shallow reinforced concrete floor slabs as a composite structure. In such a building stay-in-place corrugated steel sheets are used to support wet concrete fill between structural members. Horizontal rebar is placed as shop-welded mats, not one at a time.

The finished concrete slab is supported on the top flanges of the wide flange structural steel members. Studs welded to the top flange protrude into the concrete slab to make the two different building materials act as a single composite structure. Composite design results in savings by requiring fewer columns, beams and connections, producing longer spans and larger rooms in buildings, and providing more flexible, and saleable floor plans. The downside of this type of construction is that the steel beams supporting composite floor slabs are exposed and must be fireproofed, another labor intensive, time consuming and costly activity.

The '262 patent discloses a panelized mold apparatus for containing, shaping and permanently encasing monolithically cast reinforced concrete walls, footings, beams and floor slabs using interlocking panel assemblies to form foundation, cavity wall and roof deck void spaces.

The perforated steel sheets used to attach parallel wall assemblies together and prevent the two sides of the cavity walls from separating during the casting process are not considered as reinforcing steel when calculating the tensile requirements for the structure. Nor are the perforated steel sheets in the footings and truss assemblies considered as reinforcement.

The '262 patent does not disclose how horizontal and vertical reinforcing steel rods are to be installed within the void spaces when the perforated sheet steel attachments are spaced at such close intervals. Nor does the patent disclose how vertical wall assemblies are to be supported against hydrostatic loads when distance between the inside and outside wall assemblies forming the void space is excessive as in the case of large dimensioned pile caps, deep deck, floor and roof slabs, foundations and piers supported on piles; nor does the '262 patent disclose how the horizontal platform assemblies are to be supported to carry gravity loads associated with casting reinforced concrete slabs over very long spans without intermediary supports or shoring.

The '262 patent does not disclose how the panelized assemblies are to be erected and rebars installed when the work site is under water. Typically, the work site must be made dry in order for the workers to erect formwork and install rebar. Making a work site dry in the middle of a body of water requires construction of a water tight enclosure, dewatering and other tasks prior to commencing concrete work, tasks that add considerable time and cost to a construction project.

It is the object of the present invention to provide a means for structurally supporting vertical and horizontal stay-in-place panelized encasement assemblies of a modular steel-framed construction mold apparatus by integrally attaching the panelized encasement assemblies to a structural steel grillage, said grillage being capable of supporting said assemblies vertically to great depths and heights, and horizontally over very long spans without recourse to external supports.

It is also an object of the present invention for the steel grillage to provide tensile strength to the permanently encased monolithic composite concrete and steel structure, thereby eliminating the necessity, and costs of installing rebar at the work site.

It is another object of the present invention to integrally attach the panelized encasement assemblies of the mold apparatus directly to structural members of the steel grillage so the two systems act as a composite unit.

It is yet another objective of the present invention to increase productivity at the construction site by pre-assembling the structural steel grillage into modular units off-site under controlled conditions.

Another object of the present invention is to pre-assemble encasement panels and connectors off-site and attach them to the grillage to form a modular unit of a steel-framed construction mold apparatus, which can be transported to the site ready for immediate installation, greatly reducing construction activity at the work site and making underwater construction of composite concrete and steel structures both practical and economical.

Another object of the present invention is to reduce the costs and facilitate construction of permanently encased monolithic composite concrete and steel structures underwater by eliminating the need for constructing temporary watertight structures typically used to create a dry work area in a submerged work site.

SUMMARY OF THE INVENTION

The above objects are met in the present invention by panelized encasement assemblies integrally attached to vertical and horizontal members of a structural steel grillage that can be used to advantage for underwater construction of large monolithically cast concrete and steel civil engineering works that include bridge abutments, piers, decks and superstructures, piles and pile caps, foundation, floor and roof slabs, shear walls, core walls, retaining walls and footings, deep foundation walls, seawalls, box culverts, flood protection cofferdams, off-shore barrier reefs and coastal islands. While steel is referred to herein it will be understood that for particular applications steel sheets, I-beams, angles, and channels and other shapes used as purlins, girts, columns, connectors, girders and bollards can be made of other metals and/or be substituted with fiber reinforced composites where fibrous reinforcements are metal, carbon or glass and the matrix is plastic, metal or carbon.

Additionally the present invention can be used to advantage in providing strength to hold panelized encasement assemblies in place before and during the casting process, and after casting providing tensile strength and rigidity to composite structures without recourse to conventional steel reinforcement rods typically employed for this purpose, Additionally, the present invention in any of the cited or other such dry land applications can be used with reinforcing rods or the like in the construction of permanently encased monolithic composite concrete and steel structures to provide additional tensile or bending strength, as specified by the design engineer.

The construction mold for forming, casting, and encasing the above composite concrete and steel structures is comprised of foundation/footing, cavity wall and roof deck encasement sub-assemblies joined together to act as a single structural unit that forms structured void spaces for receiving wet concrete in situ underwater and on dry land.

The panelized encasement assembly component of the modular steel-frame construction mold apparatus is comprised of interlocking encasement panels and connectors that are integrally attached to a corresponding structural steel grillage component. T-shaped tension keys protruding from the end walls of encasement panels matingly interlock with keyways formed in the body of connector brackets. The reverse is also feasible, i.e. keys on the brackets and keyways formed on the end walls. In addition, connector brackets are the means of removeably and integrally attaching the encasement assemblies to the structural steel grillage.

Concrete is cast into the foundation, cavity wall and roof deck void spaces formed by the modular steel-framed construction mold apparatus in a substantially continuous fashion to produce a monolithic permanently encased composite concrete and steel structure.

The encasement assemblies remain in place after the wet concrete has been cast into them, protecting the inner and outer surfaces of the composite concrete and steel foundations, walls and columns, and the under surface of composite concrete and steel floor and roof slabs. The structural steel grillage becomes permanently embedded in the wet concrete during the casting process and provides tensile strength complementing the compressive strength of concrete in the resulting structure.

The advantage of the present invention is that the structural steel I-beams, angles, channels and other standard sections making up the grillage component provide a strong and rigid means of supporting the encasement assemblies during fabrication, shipping, handling, installation and casting. Another advantage is the structural steel grillage component facilitates construction of composite concrete and steel structures underwater. Yet another advantage the structural steel grillage provides is to enable forming and casting of very wide horizontal structures such as piers and pile caps, and very long unsupported horizontal spans such as bridges, box culverts, and box girders. The structural steel grillage provides a stronger and more practical means of supporting encasement assemblies than the perforated steel tie sheets called for in the '262 patent, eliminates the need for installing reinforcing steel at the work site, and makes construction of composite concrete and steel structures simpler, safer, and more economical, both on dry land and underwater.

Other objects, features and advantages will be apparent from the following detailed description of preferred embodiments thereof taken in conjunction with the accompanying drawings in which:

DETAILED DESCRIPTION OF PREFERRED EMBODIMENTS

Figure 1:
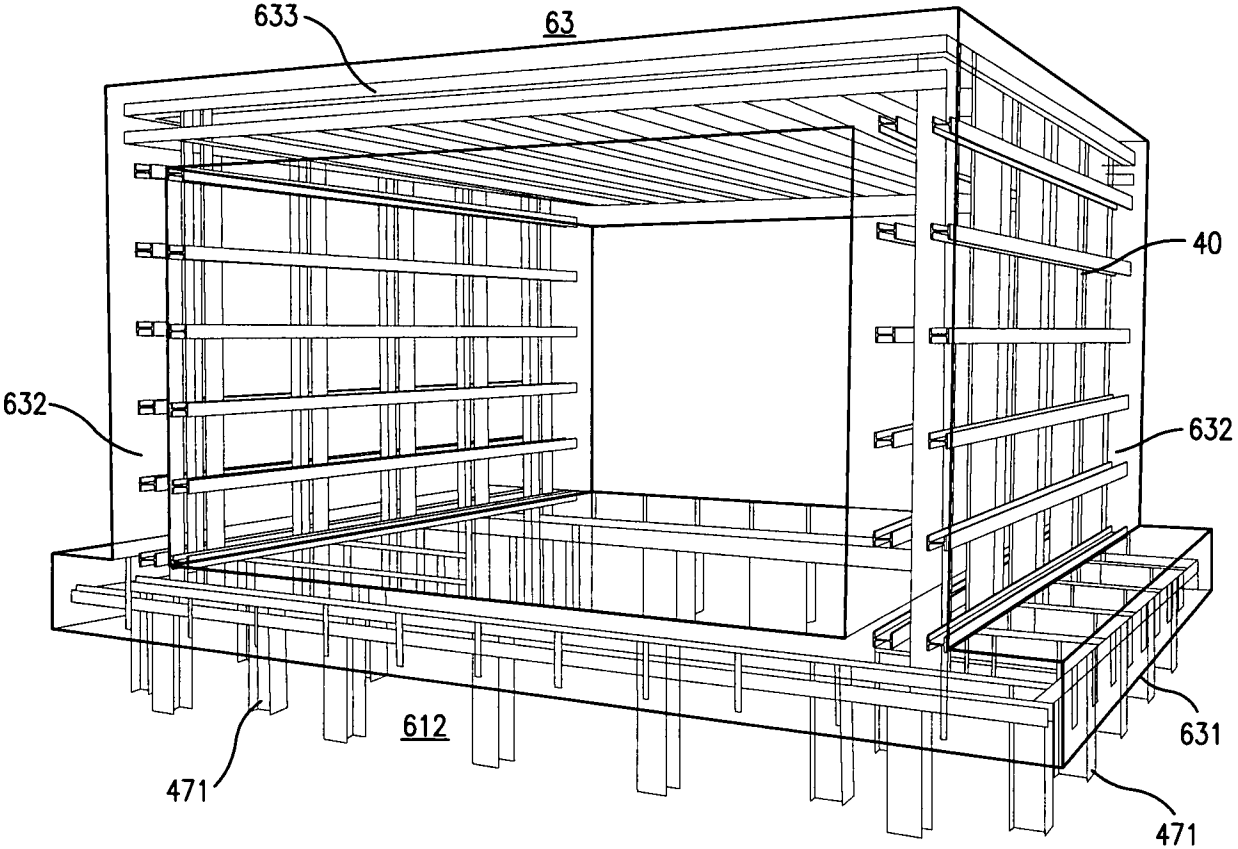
FIG. 1 is a phantom view showing a modular segment of an open-ended monolithic composite concrete and steel structure.

Referring now to the drawings, in which like numerals indicate like elements throughout several views and pointing out that all protruding interlocking elements integrally attached to various encasement components are configured to slidably interlock.

Corresponding housings formed within the bodies of various encasement elements are likewise identical in configuration and size and capable of slidably interlocking and engaging all protruding elements.

FIG. 1 shows a phantom view of an open-ended monolithic composite concrete and steel segment of a box structure 63 composed of foundation slab 631, side walls 632 and roof slab 633 formed and cast using a modular unit of a steel-framed construction mold apparatus. The encasement component of the mold apparatus is not shown for clarity. The steel grillage component 40 of said modular unit is shown embedded within the concrete segment 63. Steel bollards 471 supporting the grillage component extend downward beneath the concrete foundation into the sub-base material 612 supporting the segment.

Figure 2A:
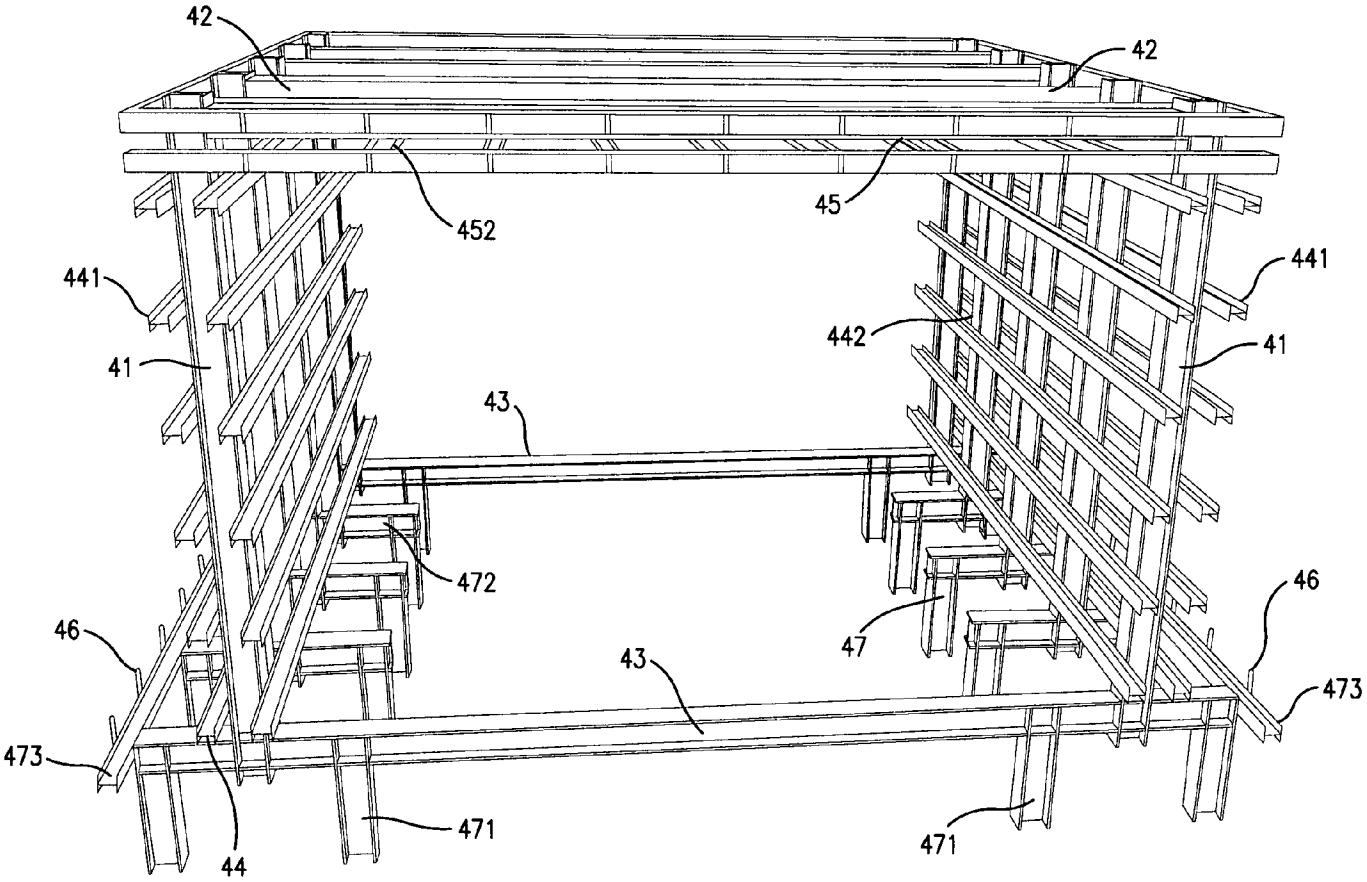
FIG. 2A is a perspective view showing the steel grillage component for a modular unit of a steel-framed construction mold apparatus used to form, cast and encase the segment of an open-ended monolithic composite concrete and steel structure shown in FIG. 1.

FIG. 2A shows the preferred embodiment of the steel grillage component of a modular steel-framed construction mold apparatus without concrete fill or the corresponding encasement component.

Each column 41 is supported by and integrally attached to a steel pedestal 47 comprised of two bollards 471 and integrally joined at the top by cross beam 472. Roof girder, joist or truss member 42 integrally joins the top portion of two opposing columns 41 to form a rigid bent. Base beam 43 integrally joins the pedestals 47 of two opposing columns 41. A plurality of evenly spaced horizontal beams or girls 441 are integrally attached to the outside flange of columns 41 in each row. A plurality of girls 442 are likewise attached to the inside flange of columns 41 in each row spaced opposite to the outside girls 441. A plurality of roof beams or purlins 452 are integrally attached to the lower flange of the roof girders 42. Steel brackets 46, integrally attached to grillage gills 44 and purlins 45, project away from the grillage into the void space 20, integrally attach to corresponding encasement brackets projecting inward to void space 20 from the encasement component of the modular mold unit shown in FIG. 2B.

The length of a steel-framed construction mold apparatus modular unit is defined by the horizontal girls 44 attached to the grillage columns 41 and purlins 45 attached to the roof girders 42. Grillage columns 41 define the height of the modular unit, and roof girders 42 and base beams 43 define its width. The structural steel elements comprising the grillage component 40 of the steel-framed construction mold apparatus modular unit, including columns 41, base beams 43, gifts 44, purlins 45, bollards 471 and cross beams 472 may be sized and dimensioned to the design engineers specifications to meet the loading and functional requirements of the resulting composite concrete and steel structure, existing site considerations, availability of equipment and resources at the work site, and other variable parameters associated with usage and construction activities.

Figure 2B:
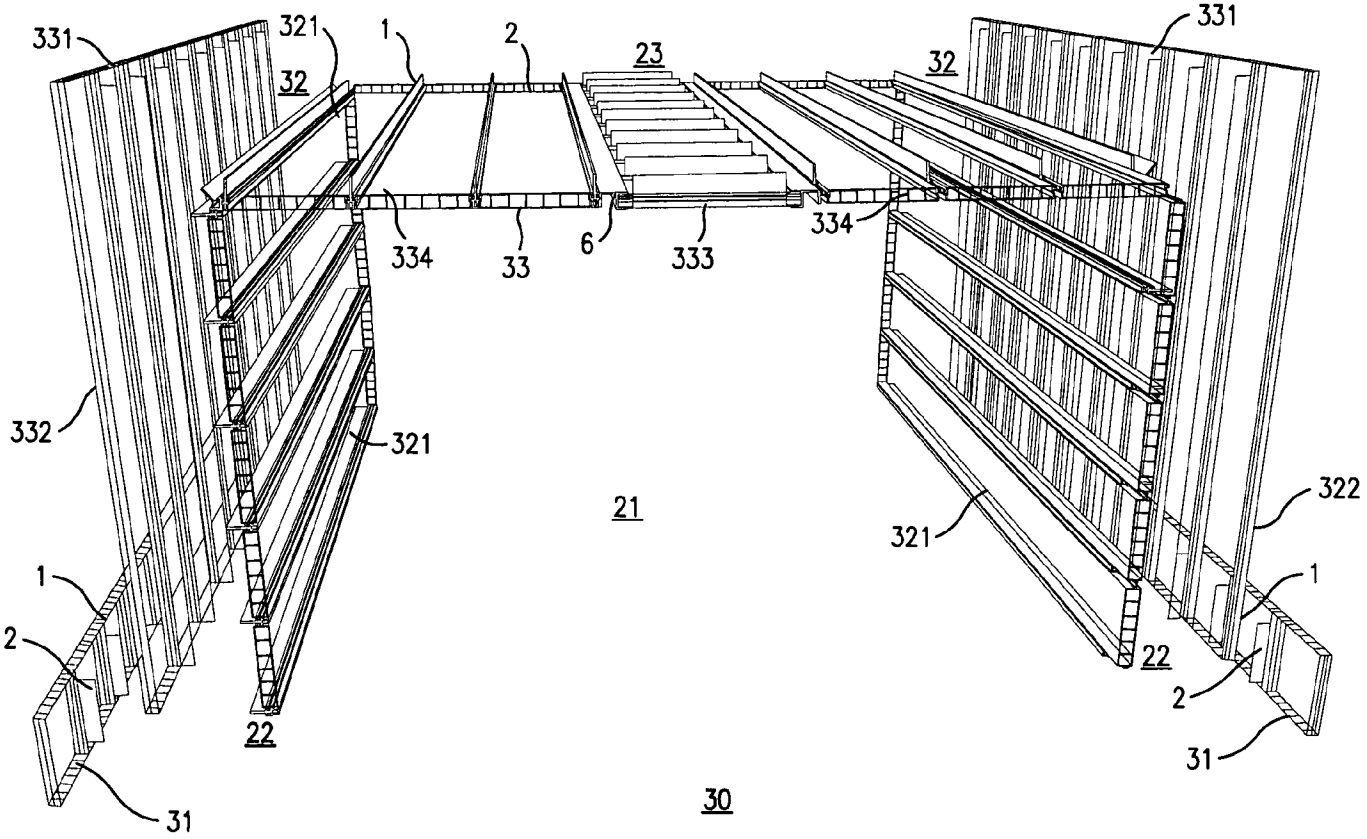
FIG. 2B is a perspective view showing the panelized encasement assembly component for a modular unit of a steel-framed construction mold apparatus used to form, cast and encase the segment of an open-ended monolithic composite concrete and steel structure shown in FIG. 1.

FIG. 2B shows the preferred embodiment of the panelized encasement component 30 of a modular unit of a steel-framed construction mold apparatus corresponding to the grillage component that supports the panelized encasement component sub-assemblies. The panelized encasement component consists of foundation 31, cavity wall 32 and roof deck 33 panelized sub-assemblies which define and form foundation 21, cavity wall 22 and roof deck 23 void spaces respectively.

The foundation encasement sub-assembly 31 which defines and forms the foundation slab void space 21 is comprised of a plurality of encasement panels 1 integrally connected together to form a sold wall by panel connector brackets 2. The panel connector brackets 2 integrally attach to corresponding steel brackets 46 attached to the structural members 44, 45 of the grillage component by bolts and nuts or other such mechanical means [not shown).

The edge of one encasement panel 1 is integrally connected to the edge of a second encasement panel 1 as described later along their longitudinal axes by slidably interlocking t-shaped tongues or keys 121 extending outward from end wall 12 of the panel into mating keyways 203 formed in the body 202 of panel connector brackets 2.

The height of the vertically aligned panels 1 and connectors 2 comprising the foundation encasement sub-assembly is specified by the design engineer.

Still referring to FIG. 2B, the cavity wall encasement sub-assembly 32 which forms and defines the cavity wall void space 22 consists of an outer side wall 322 and an inner side wall 321 each wall integrally attached by connector brackets 2 to the corresponding outside 441 and inside 442 girts of grillage component 40 of the modular unit shown in FIG. 2A.

The outer side wall 441 is vertically aligned in the preferred embodiment to facilitate joining the modular construction unit to a second previously installed modular construction unit at the work site and forming the outer wall 331 of the roof deck encasement sub-assembly 33.

Still referring to FIG. 2B, the inner side wall 321 of the cavity wall encasement sub-assembly 32 is aligned horizontally in the preferred embodiment to facilitate and secure the inside corner connection 4 between the cavity wall sub-assembly 321 and the roof deck sub-assembly 33. An inside corner connector bracket 4 integrally connects the horizontally aligned corner panel 1 of the inner side wall 321 to the outside corner panel 1 of the roof deck sub-assembly 33.

Still referring to FIG. 2B, panels 1 and connector brackets 2 comprising the corner section of the roof deck encasement assembly 33 are integrally connected to panels 1 and connector brackets 2 comprising the cavity wall inner side wall 321 with an inside corner connector bracket 4. Panels 1 and connector brackets 2 comprising the center section 333 of the roof deck encasement sub-assembly 33 are aligned 90° to the corner section panels 334 to accommodate variable roof width dimensions. Cap connectors 6 connect the center section sub-assembly 333 to the corner section sub-assemblies 334.

Figure 2C:
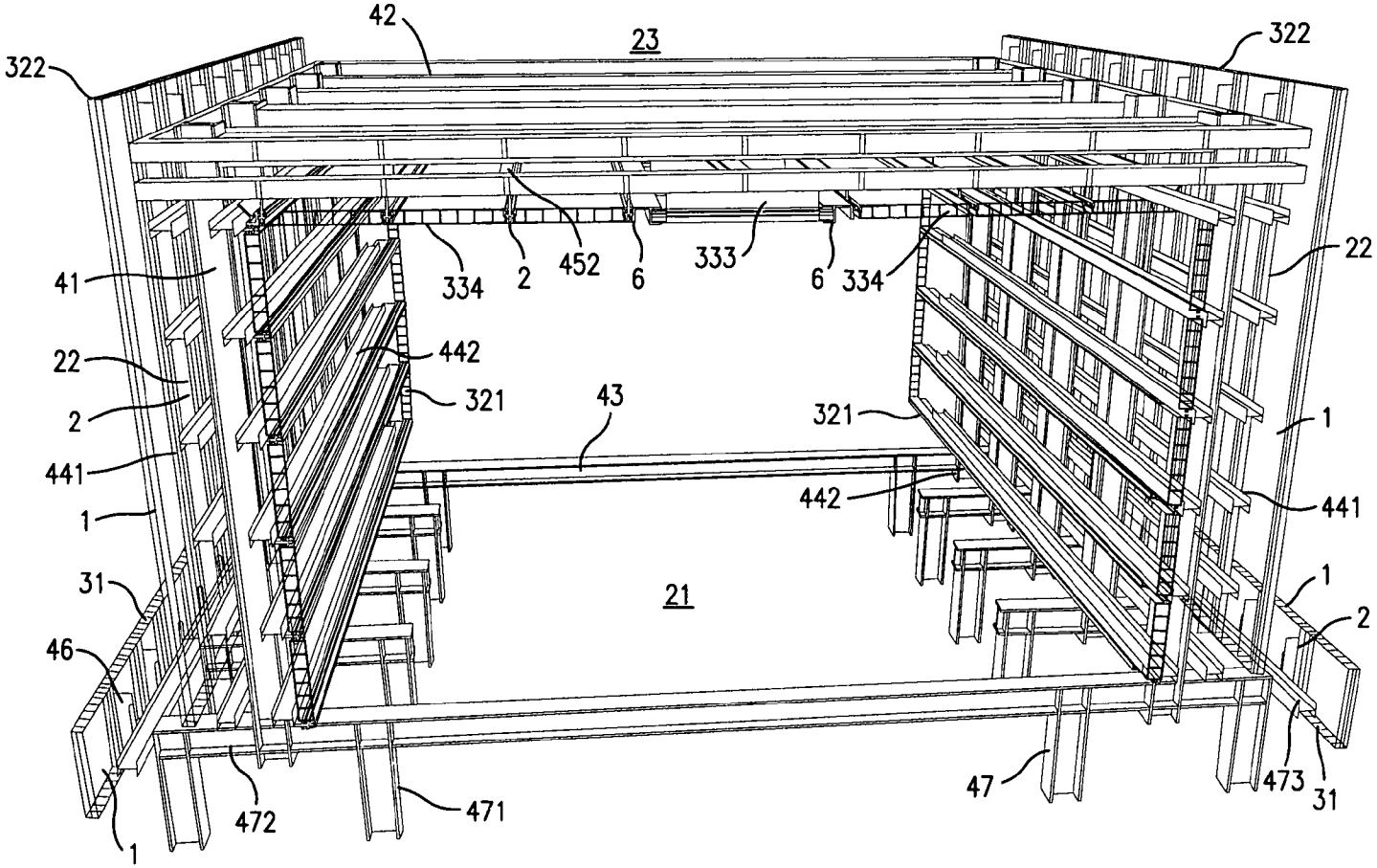
FIG. 2C is a perspective view showing the panelized encasement component of FIG. 2B integrally attached to the steel grillage component of FIG. 2A forming a modular unit of a steel-framed construction mold apparatus

FIG. 2C shows the preferred embodiment of a modular unit of a steel-framed construction mold apparatus used to form, cast and encase the segment of an open-ended monolithic composite concrete and steel box structure shown in FIG. 1 comprised of the panelized encasement component shown in FIG. 2B integrally attached to the steel grillage component shown in FIG. 2A. FIG. 2C shows foundation void space 21 formed by foundation wall encasement sub-assembly 31 comprised of panels 1 and connector brackets 2 integrally attached to steel brackets 46 projecting away from girts 473 affixed to pedestal bollards 47.

FIG. 2C also shows cavity wall void space 22 formed by cavity wall encasement sub-assembly 32 consisting of outside walls 322 comprised of panels 1 and connector brackets 2 integrally attached to steel brackets 46 projecting into void space 22 from outside girts 441 attached to columns 41 which are supported on pedestals 47 and inside cavity wall 321 panels 1 and connector brackets 2 integrally attached to steel brackets 46 projecting into void space 22 from inside girts 442 attached to columns 41.

FIG. 2C also shows roof deck void space 23 formed by the center section 333 of roof deck sub-assembly 33 comprised of panels 1 and connector brackets 2 integrally attached to steel brackets 46 extending down from purlins 452 attached to the bottom flange of girders 42 and corner sections 334 of roof deck sub-assembly 33 comprised of panels 1 and connector brackets 2 integrally attached to steel brackets 46 extending downward from purlins 452 attached to the bottom flange of girders 42.

Figure 3A:
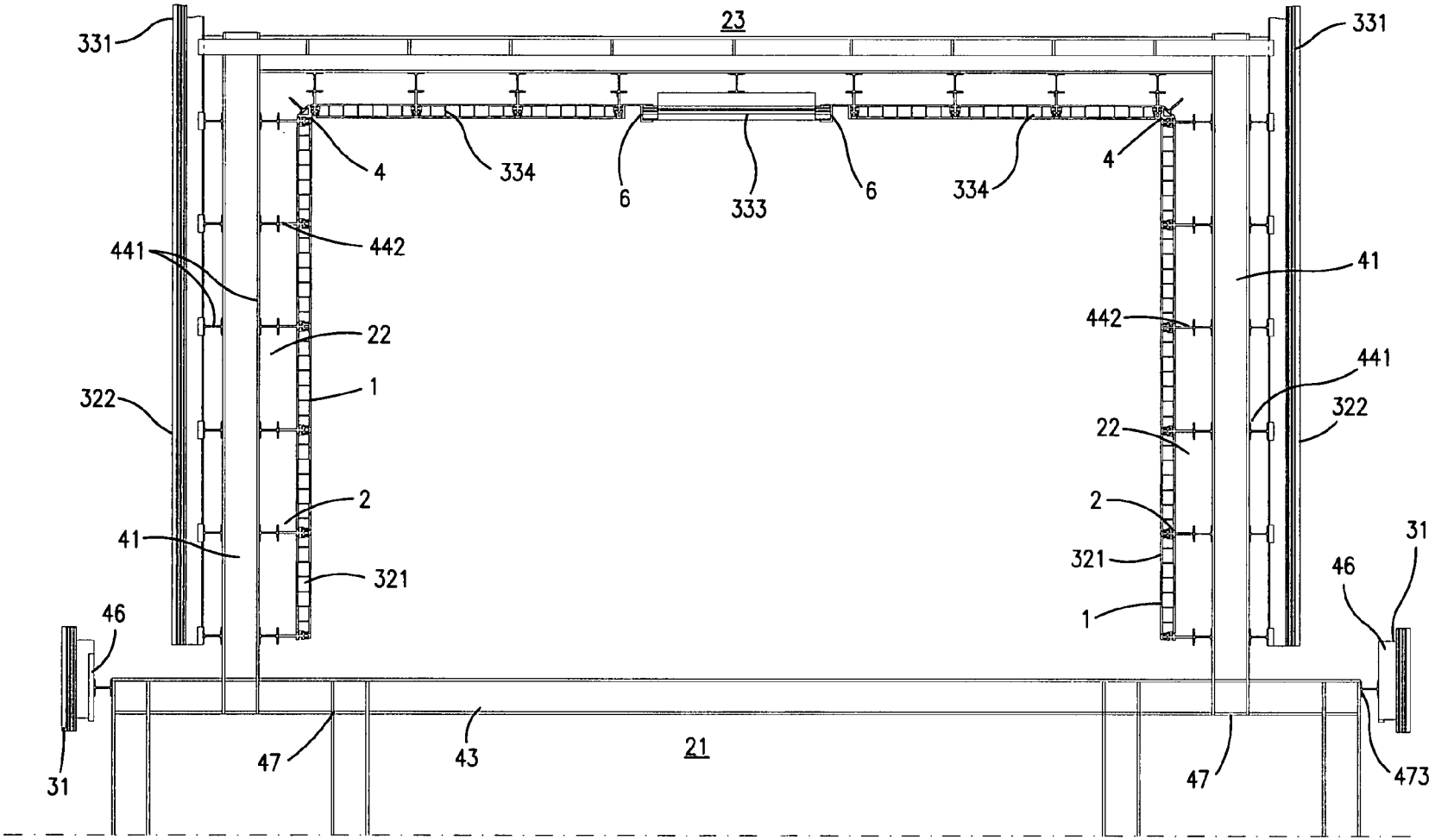
FIG. 3A is an end view of the modular unit shown in FIG. 2C.

FIG. 3A shows the end view of the foundation 21, cavity wall 22 and roof deck 23 void spaces defined and formed by a panelized encasement assembly component 30 integrally attached to the structural steel component 40 of a modular steel-framed construction mold apparatus 10. The dimensions and configuration of the void spaces vary depending on the design engineer's specifications.

Still referring to FIG. 3A, foundation void space 21 is formed by foundation encasement sub-assembly 31 integrally attached to steel brackets 46 extending away from girt 473 integrally attached to column pedestal 47 integrally joined at the ends of the module 10 by base beam 43.

Still referring to FIG. 3A, cavity wall void space 22 is formed by inside wall 321 and outside wall 322 of cavity wall sub-assembly 32 integrally attached to steel brackets 46 extending away from inside girts 442 and outside girts 441 integrally attached to inside and outside flanges respectively of columns 41.

Still referring to FIG. 3A, roof deck void space 23 is formed by corner sections 334 and center section 333 of roof deck sub-assembly 33 integrally attached to brackets 46 extending away from purlins 452 attached to the underside of girders 42 and and roof deck outer wall assemblies 331 integrally attached to brackets 46 extending away from outside gills 441 integrally attached to columns 41.

Figure 3B:
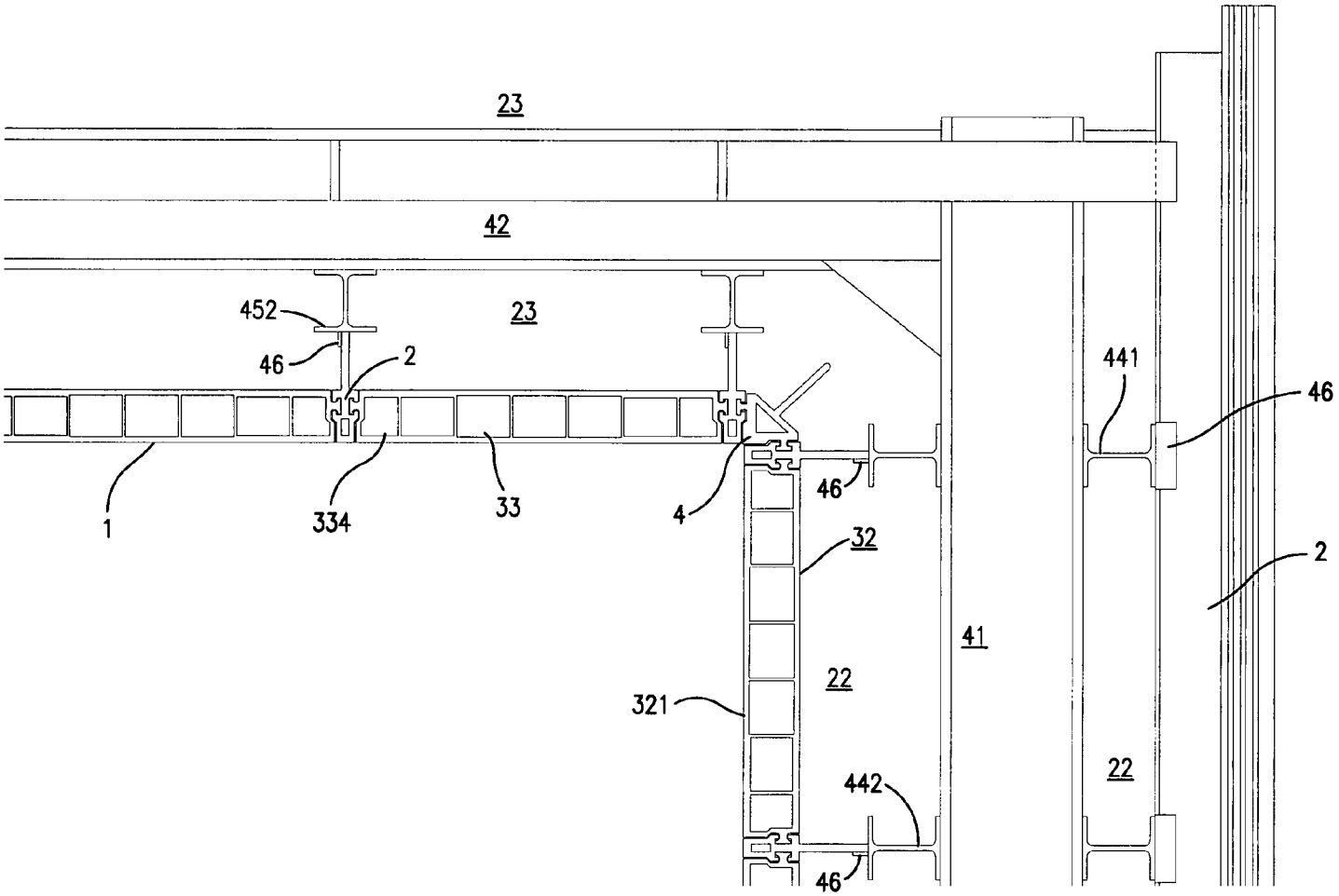
FIG. 3B is a detail view showing the interlocking corner connection between the roof deck encasement sub-assembly and inner wall of the cavity wall encasement sub-assembly shown in FIG. 3A.

FIG. 3B shows a detail view of the corner section 334 of roof deck sub-assembly 33 integrally attached to brackets 46 extending downward from purlins 452 integrally attached to girders 42 integrally connected by inside corner connector bracket 4 to the inside wall 321 of cavity wall sub-assembly 32 integrally attached to brackets 46 affixed to inside gifts 442 integrally attached to columns 41.

Figure 3C:
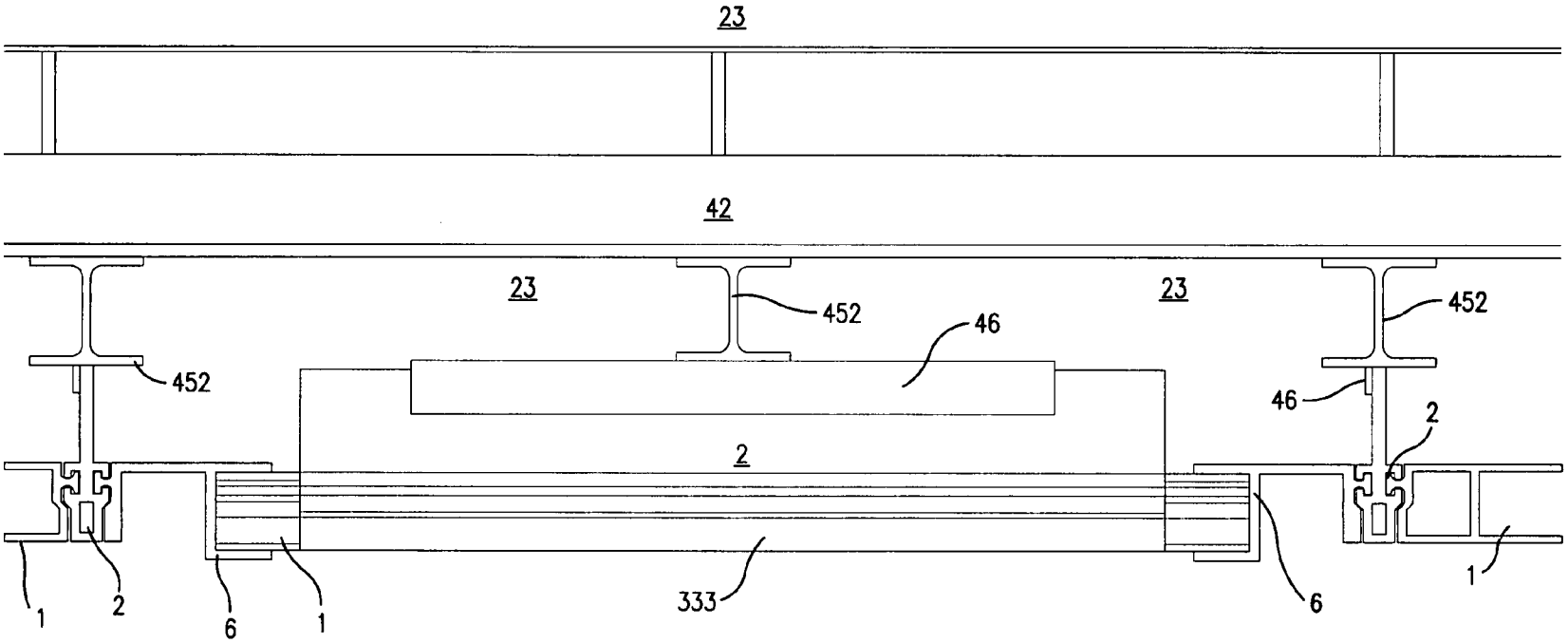
FIG. 3C is a detail view showing the variable width center section of the roof deck sub-assembly shown in FIG. 3A.

FIG. 3C shows a detail view of the center section 333 of roof deck sub-assembly 33 integrally attached to steel brackets 46 integrally attached to purlins 452 integrally attached to girders 42 and connected to the corner sections 334 of roof deck sub-assembly 33 by cap connectors 6.

Figure 3D:
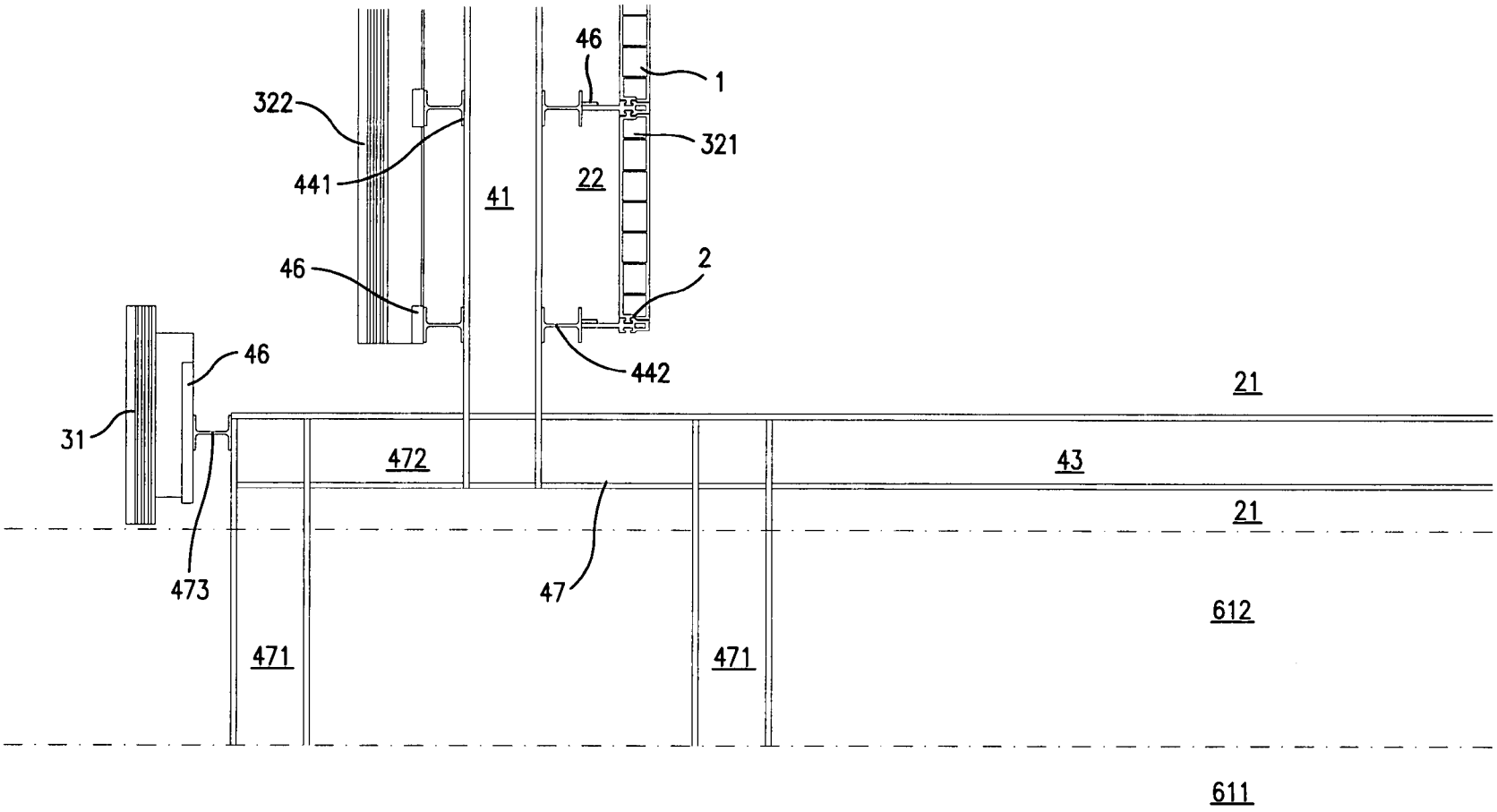
FIG. 3D is a detail view showing the pedestal connection between the foundation encasement sub-assembly and the cavity wall encasement sub-assembly shown in FIG. 3A.

FIG. 3D shows a detail view of the contiguous nature of foundation void space 21 and cavity wall void space 22. Foundation void space 21 is formed by foundation encasement sub-assembly 31 integrally attached to bracket 46 extending out from girt 473 integrally attached and supported by steel pedestal 47 comprised of two bollards 471 and cross beam 472 supporting column 41 and integrally joined to base beam 43. The base of bollard 471 rests on undisturbed subbase 611 and embedded in stone or gravel backfill material 612 which supports foundation concrete fill 631 (not shown) cast into void space 21. Cavity wall void space 22 is formed by inside wall 321 and outside wall 322 of cavity wall sub-assembly 33 integrally attached to steel brackets 46 extending away from inside girts 442 and outside girts 441 respectively integrally attached to and supported by columns 41.

Figure 4A:
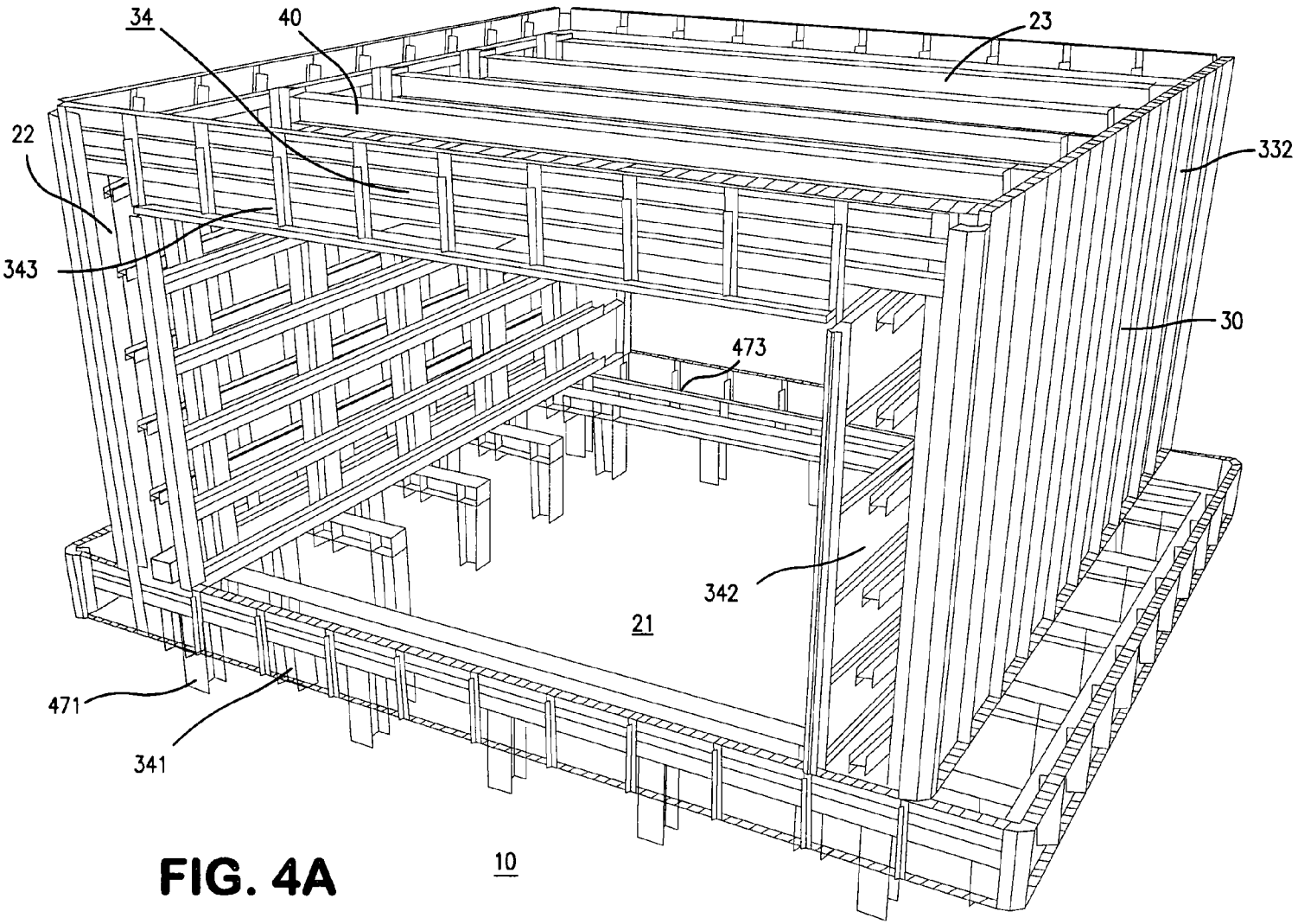
FIG. 4A is a perspective view showing the end walls of a modular steel-framed construction mold apparatus used to form, cast, and encase an open-ended permanently encased monolithic composite concrete and steel structure of finite length.

FIG. 4A shows a phantom view of the preferred embodiment of a modular steel-framed construction mold apparatus 10 for forming, casting and encasing an open-ended monolithic composite concrete and steel box structure. The modular unit forming foundation 21, cavity wall 22, and roof deck 23 void spaces is comprised of a panelized encasement assembly component 30 with end walls 34 integrally attached to a structural steel grillage component 40 supported on bollards 471 ready for installation at the work site. Foundation girts 473 and bollards 471 spaced across the opening of the structure support end walls 341. End wall panels 342 define and enclose cavity wall void space 22. End wall encasement panels 343 define and enclose roof deck void space 23.

Figure 4B:
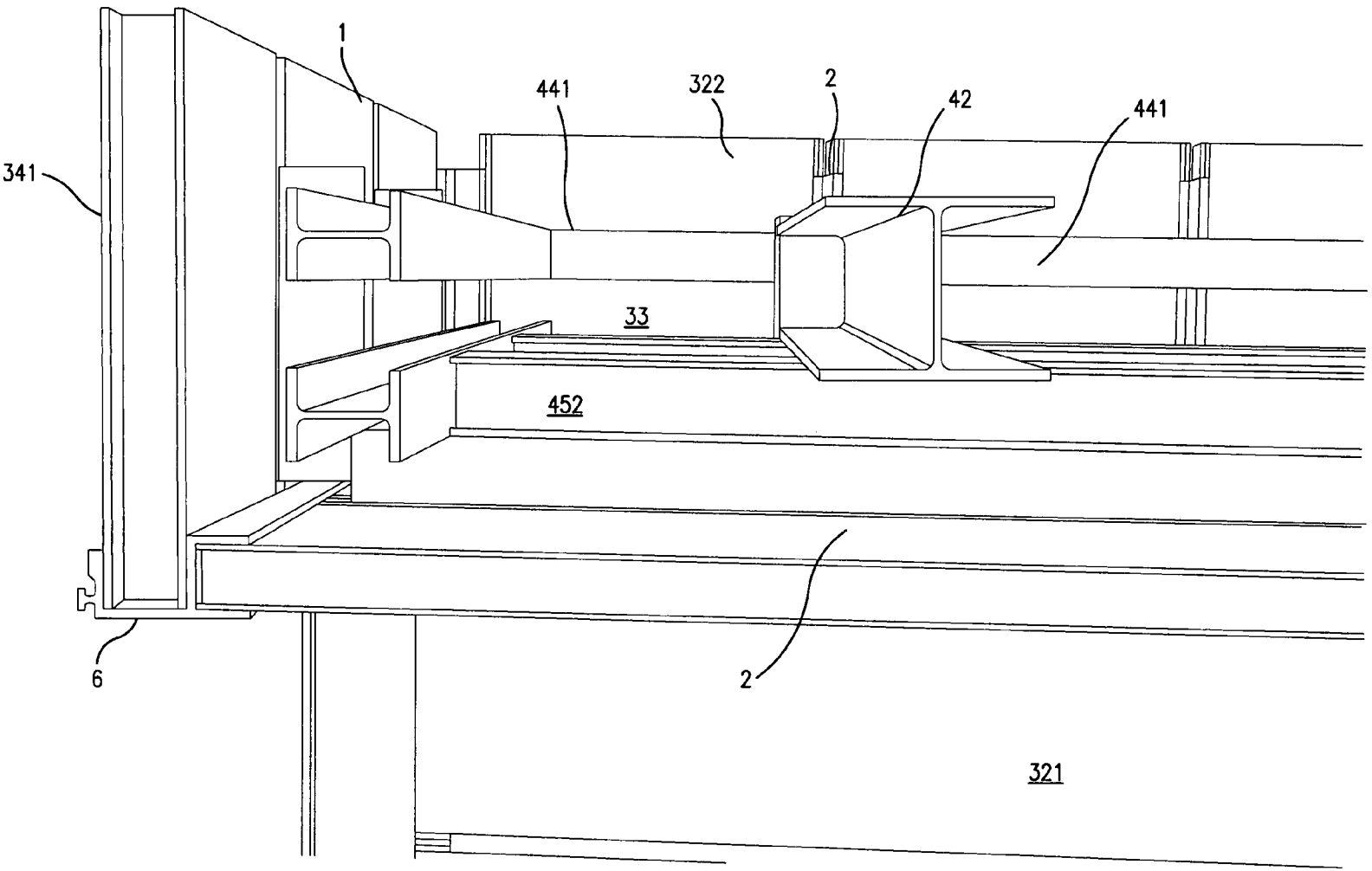
FIG. 4B is a detail view showing the connection between the roof deck encasement sub-assembly and the roof deck end wall shown in FIG. 4A.

FIG. 4B shows a detail view of the end wall encasement sub-assembly 341 connection to roof deck encasement sub-assembly 33 using cap connector 6 and the corresponding girder 42, outside girt 441 and purline 452 members of the grillage component 40 supporting the encasement assemblies.

Figure 5A:
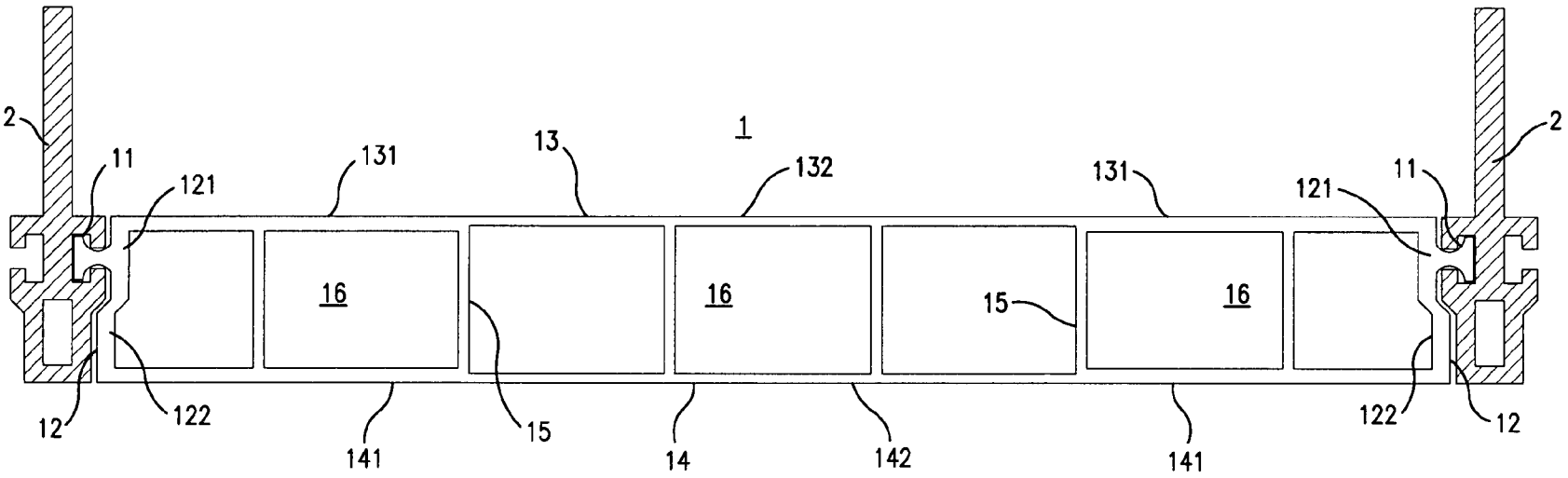
FIG. 5A is a cross-section of a multi-cell hollow-core reinforced polymer encasement panel.

FIG. 5A shows a cross section view of the preferred embodiment of a hollow core reinforced polymer encasement panel 1 of constant width, roughly 24", and depth 3" and variable length supported by interlocking panel connector brackets 2 matingly connected to t-shaped tongues 11 protruding outward from the distal end walls 12 of said panel that form the panel edges. Said panel is comprised of two parallel interior 13 and exterior 14 walls connected by spaced apart web walls 15 forming a plurality of interstices 16 that exist along the entire longitudinal axes of the panels;

T-shaped tensile keys or tongues 11 protruding from the end walls 12 of the panel are situated in the wall section above the panel cross-section centerline 121 to fully resist the tensile forces imposed upon the panel during the casting process. The section of the end wall of the panel below the centerline of the panel section 122 is thickened to fully resist compression forces imposed during casting. Interior 131 and exterior 141 panel walls for the first two cell widths in from the ends of the panel are thicker than the interior 132 and exterior 142 panel walls in the center portion of the panel in order to resist bending without breaking during casting.

Figure 5B:
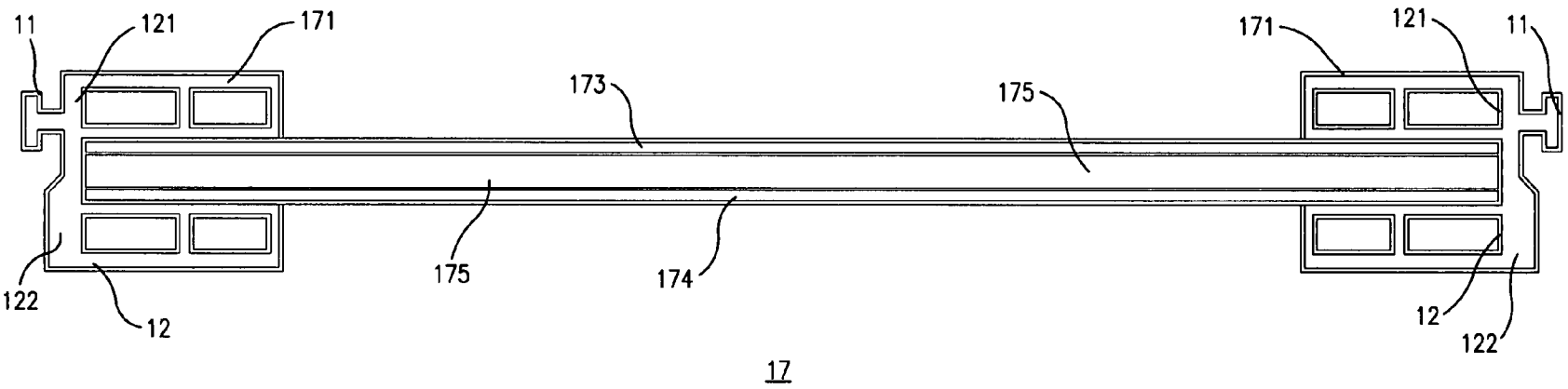
FIG. 5B is a cross-section of a composite foam-core encasement panel with reinforced polymer end connectors integrally attached.

FIG. 5B shows a cross-section view of the preferred embodiment of a composite foam-core encasement panel 17 of variable width with reinforced polymer end connectors 171 integrally attached to the longitudinal edges of said panel. Said panel is comprised of two parallel internal 173 and external 174 walls made of rigid high strength material separated and bonded together by a rigid foam substance 175 to form a laminated composite structural unit. Hollow-core reinforced polymer end connectors 171 integrally attached to the longitudinal edges of said panel matingly interlock with panel connector brackets 2 (not shown).

T-shaped tensile keys 11 protruding from the end walls 12 of the polymer end connector are situated in the wall section above the panel centerline 121 to fully resist the tensile forces imposed upon the panel during the casting process. The section of said end wall below the centerline 122 is thickened to fully resist compression forces imposed during casting.

Figure 5C:
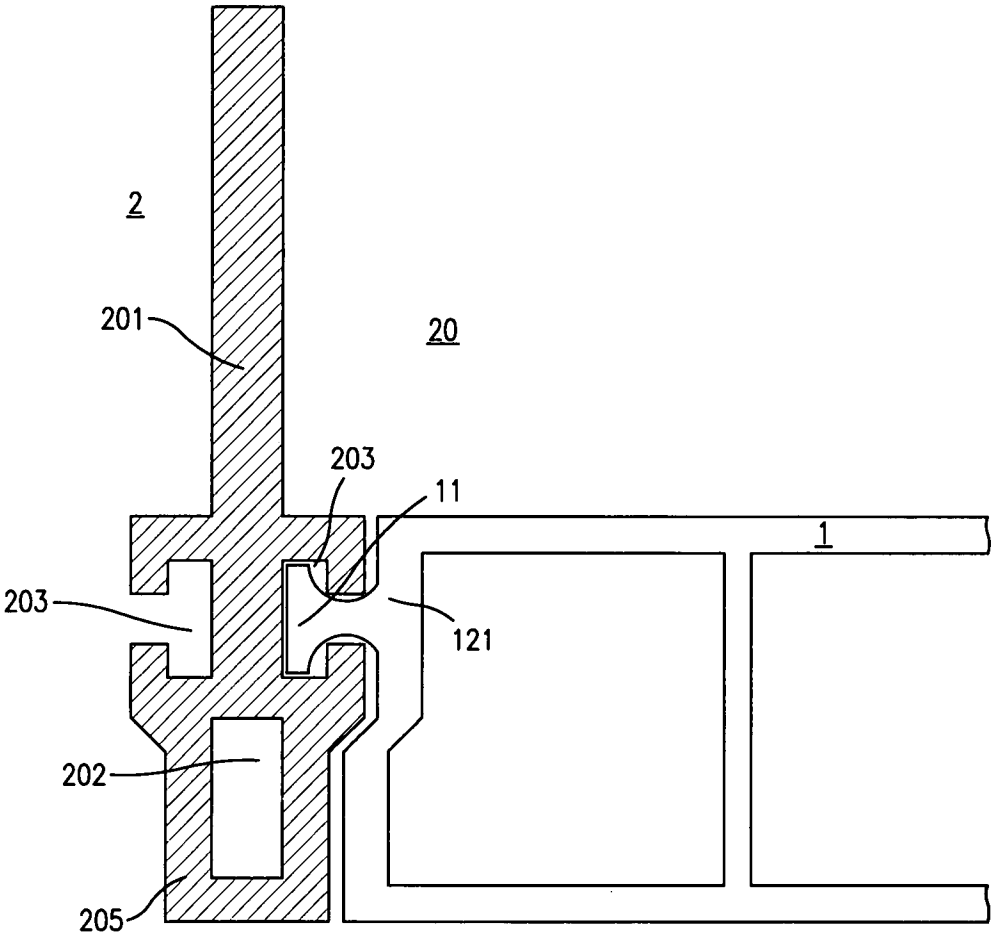
FIG. 5C is a cross-section of a hollow-core reinforced polymer encasement panel connector bracket.

FIG. 5C shows a cross section of a panel connector bracket 2 with one edge of interlocking encasement panel 1 of FIG. 5A integrally connected. The bracket arm 201 extends upward (inward) into the void space 20 from the body of the connector. Two t-shaped keyways 203 formed into the hollow body 202 of the connector facing away from one another at 180° are configured to matingly interlock with the corresponding t-shaped tension-key 11 protruding from the section of encasement panel end wall above the horizontal centerline of the connector body 121. The section of the hollow connector body wall 202 below the horizontal centerline 205 is thickened to resist compression.

Figure 5D:
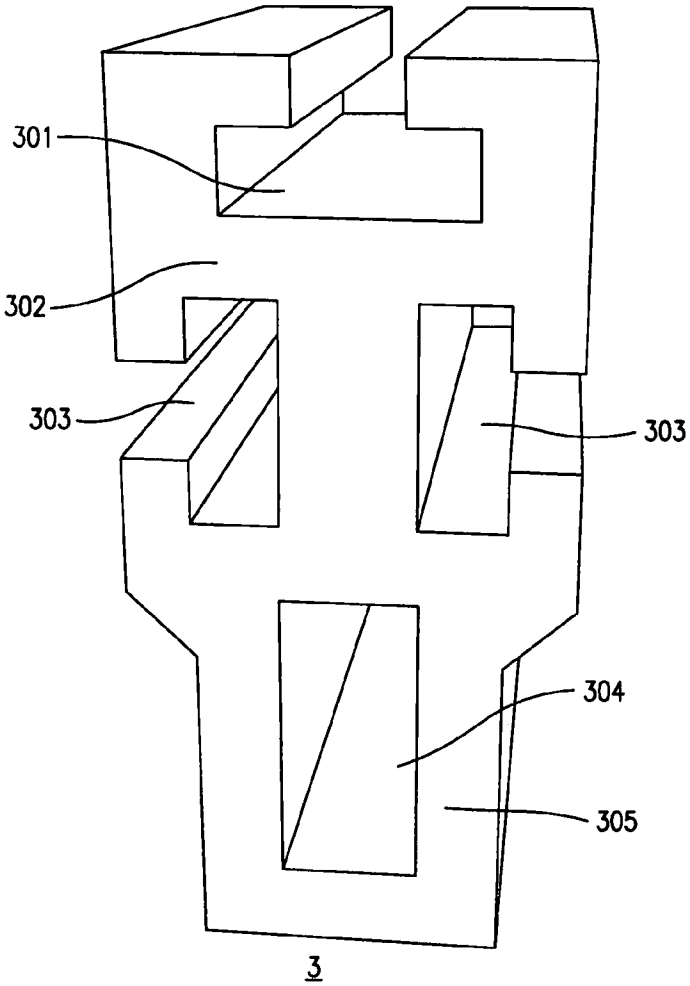
FIG. 5D is a cross-section of a hollow-core reinforced polymer panel connector with bracket keyway.

FIG. 5D shows a panel connector 3 with external t-shaped bracket keyway 301 in place of the bracket arm 201 shown in FIG. 5B formed into the extended body 302 of the connector with the keyway opening 301 oriented at 90° to the two panel connection keyways 303 for receiving the end of a custom-designed bracket (not shown).

The section of the connector body below the centerline 305 is reduced in outside dimension but the walls of the hollow body 304 (hollow body are increased in thickness to resist compression forces.

Figure 5E:
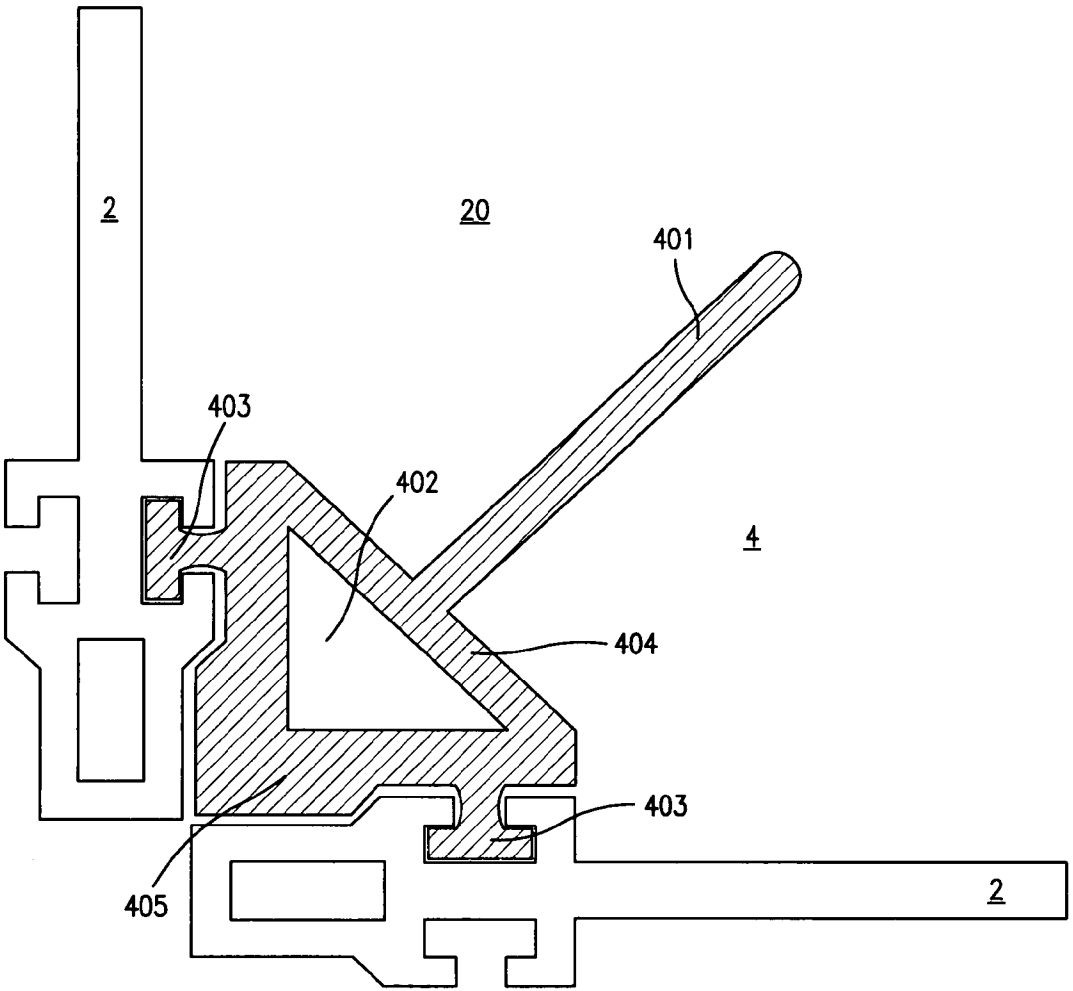
FIG. 5E is a cross-section of a hollow-core reinforced polymer inside corner connector bracket.

FIG. 5E shows a cross section of the preferred embodiment of a right triangular-shaped inside corner connector bracket 4 interlocking and integrally connecting two panel connector brackets 2 facing 90° to one another. Bracket arm 401 integrally connects to hypotenuse wall 404 of the hollow body 402 and extends roughly 4" into void space 20. Inside corner connector bracket 4 is a hollow-core reinforced polymer pultruded or extruded structural element consisting of two t-shaped tension keys 403 located above the panel section centerline protruding away from the hollow body 402 at 90° to one another that slidably interlock with corresponding keyways formed into the body of the interlocking panel connectors 2. The walls at the apex portion of the hollow body 405 are thickened to resist compression forces.

Figure 5F:
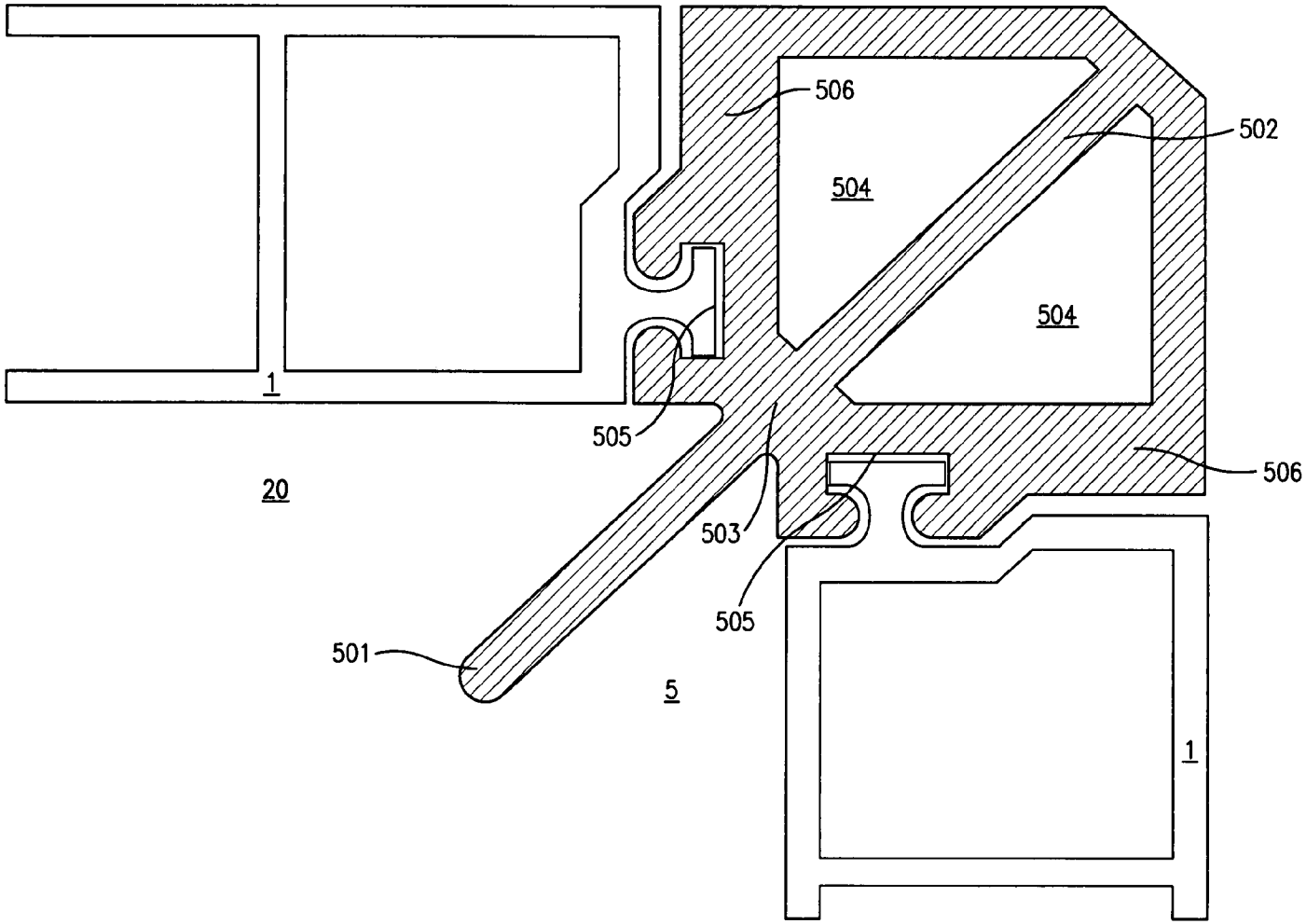
FIG. 5F is a cross-section of hollow-core reinforced polymer outside corner connector bracket.

FIG. 5F is a cross section of the preferred embodiment of a square shaped outside corner connector bracket 5 integrally connecting the edges of two encasement panels 1 oriented at 90° to one another. The bracket arm 501 integrally formed and connected to the corner and internal web 502 of the hollow connector body 503 extends roughly 4" into void space 20. The web forms two interstices 504 within the body of the connector that extend the entire longitudinal axis of the connector.

Outside corner connector bracket 5 is a hollow-core reinforced polymer pultruded or extruded structural element consisting of two t-shaped grooves or keyways 505 formed at 90° to one another into the square-shaped hollow body 503 of the connector. Keyways 505 are configured to receive t-shaped tension keys 11 protruding form the edges of the two encasement panels 1 interlocked and integrally connected by the connector. The section of the walls of the hollow body opposite the keyways 506 is thickened to resist compression forces.

Figure 5G:
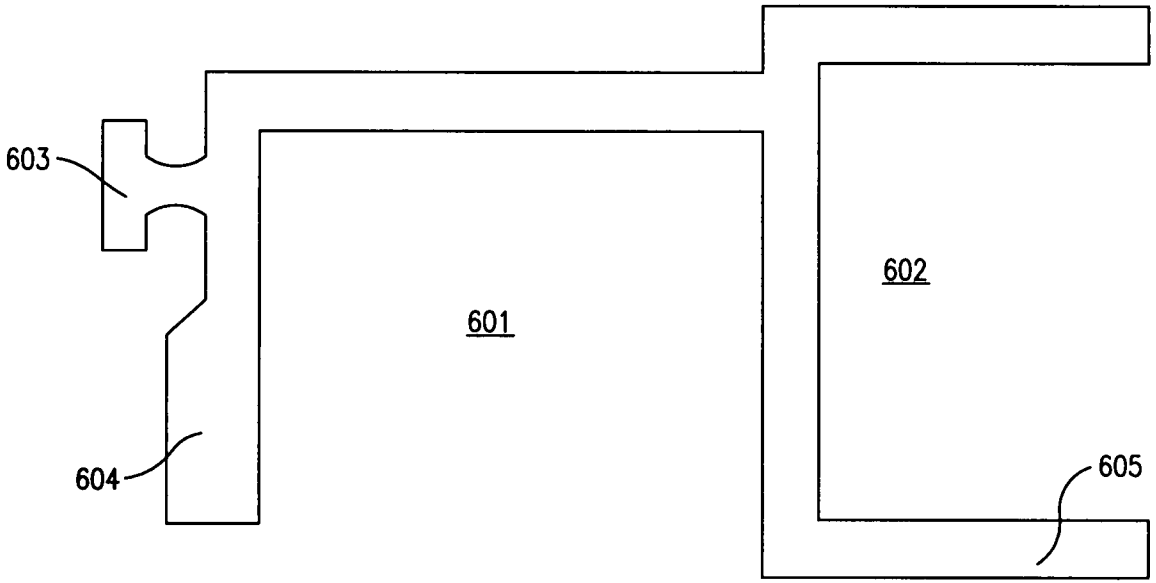
FIG. 5G is a cross-section of a reinforced polymer connector cap.

FIG. 5G shows a cross section of the preferred embodiment of a cap connector profile 6, a reinforced polymer pultruded or extruded structural element comprised of one channel 601 configured to receive the butt end of one encasement panel 1 (not shown), a second channel 602 aligned 90° to the first channel 601 configured to receive the butt end of a second encasement panel 1 (not shown], and tension key 603 extending away from the wall 604 of the first channel 601 at 90° that matingly interlocks with a corresponding keyway 203 formed in the body of an encasement panel connector bracket 2 or keyway 303 formed in the body of panel connector with bracket keyway 3. The lower section of channel wall 604 is increased in thickness to resist compression forces. The lower end of channel wall 604 aligns with the inside face of channel wall 605.

Figure 6A:
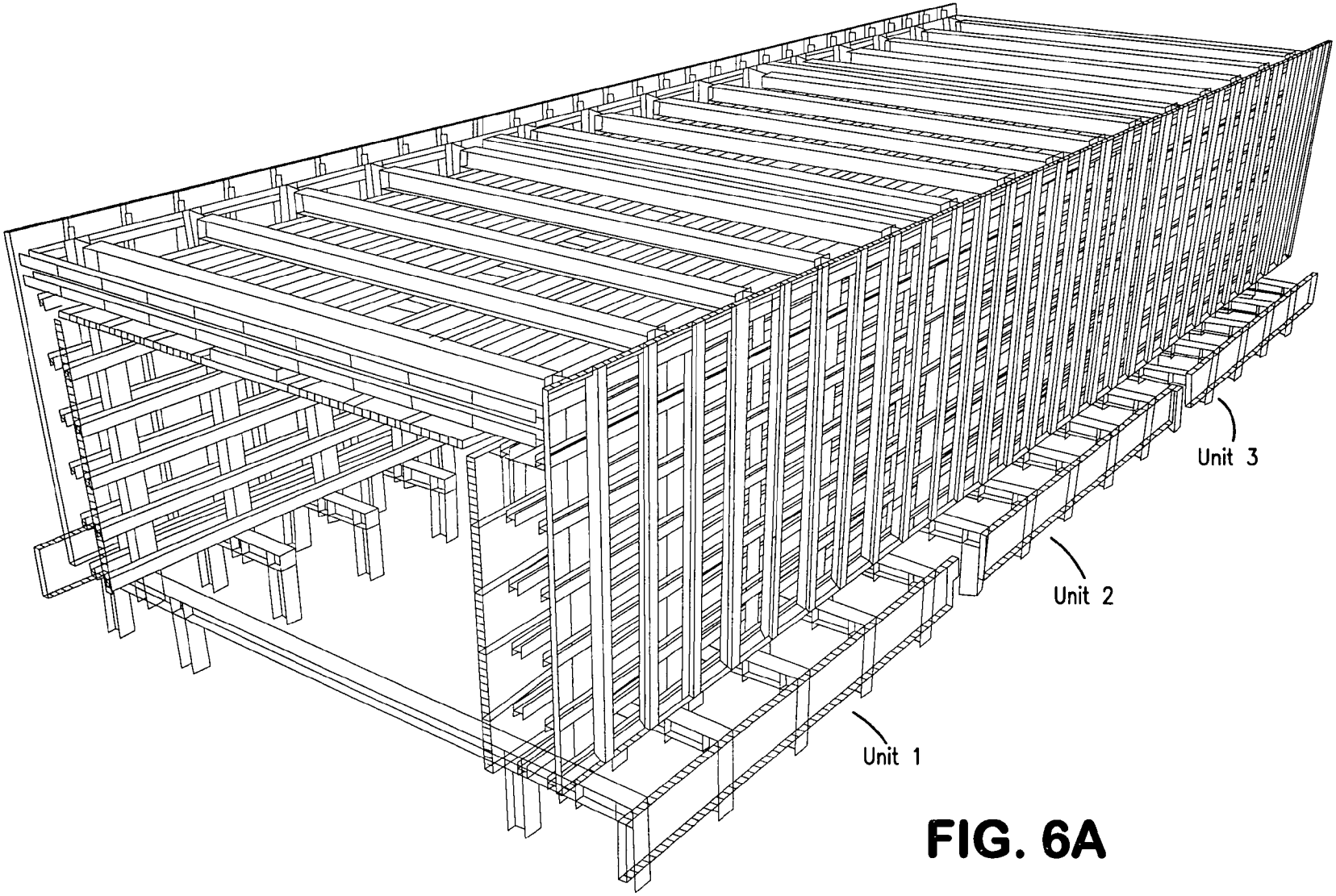
FIG. 6A is a perspective view showing a three unit segment of a modular steel-framed construction mold apparatus used for constructing an open-ended monolithic composite concrete and steel structure.

FIG. 6A shows a three unit segment of modular steel-framed construction mold apparatus installed at the construction site without end walls.

Figure 6B:
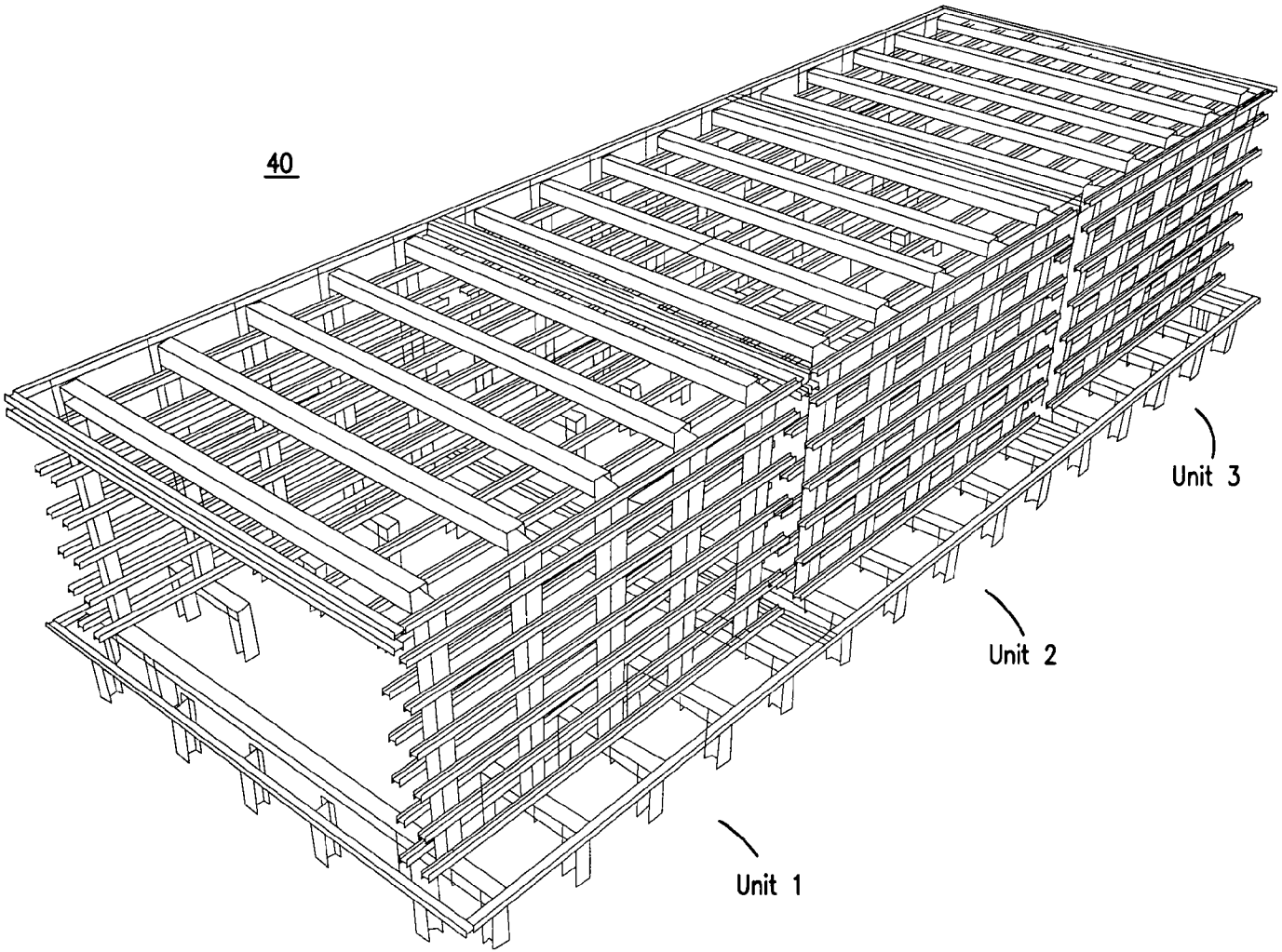
FIG. 6B is a perspective view showing the steel grillage component of the modular construction mold apparatus segment shown in FIG. 6A without the corresponding panelized encasement component.

FIG. 6B shows the structural steel grillage component of a three unit segment of modular steel-framed construction mold apparatus shown in FIG. 6A without end wall supports integrally joined together by attaching girts 44 and purlins 45 from one unit to the columns 41 and girders 42 of the adjoining unit during installation at the work site.

Figure 6C:
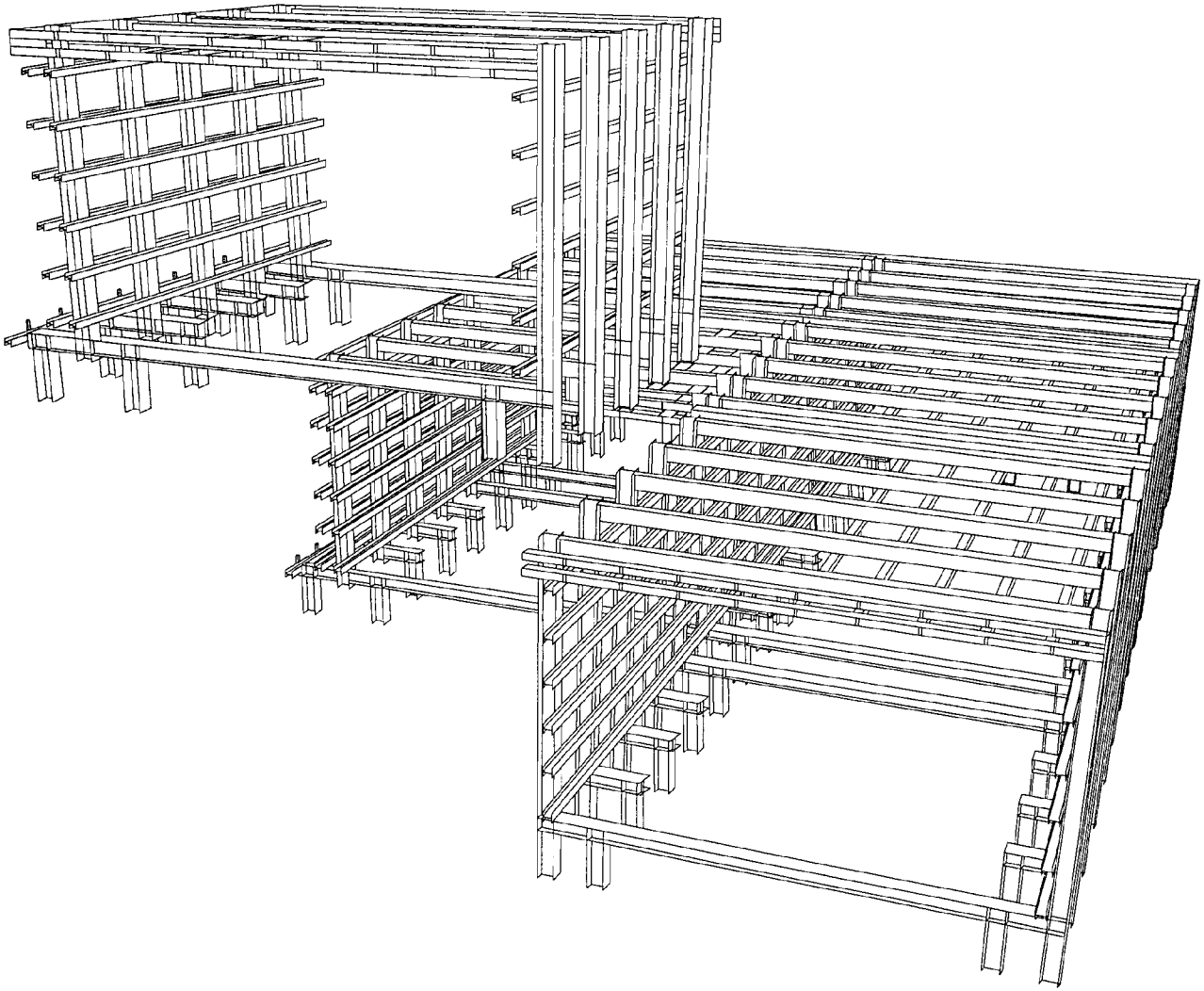
FIG. 6C is a perspective view showing the steel grillage component for a two bay three-unit segment of a modular construction mold apparatus during in situ installation without the corresponding panelized encasement component.

FIG. 6C shows the steel grillage component of a three unit two bay segment of a modular steel-framed construction mold apparatus during installation without the corresponding panelized encasement assembly component.

Figure 6D:
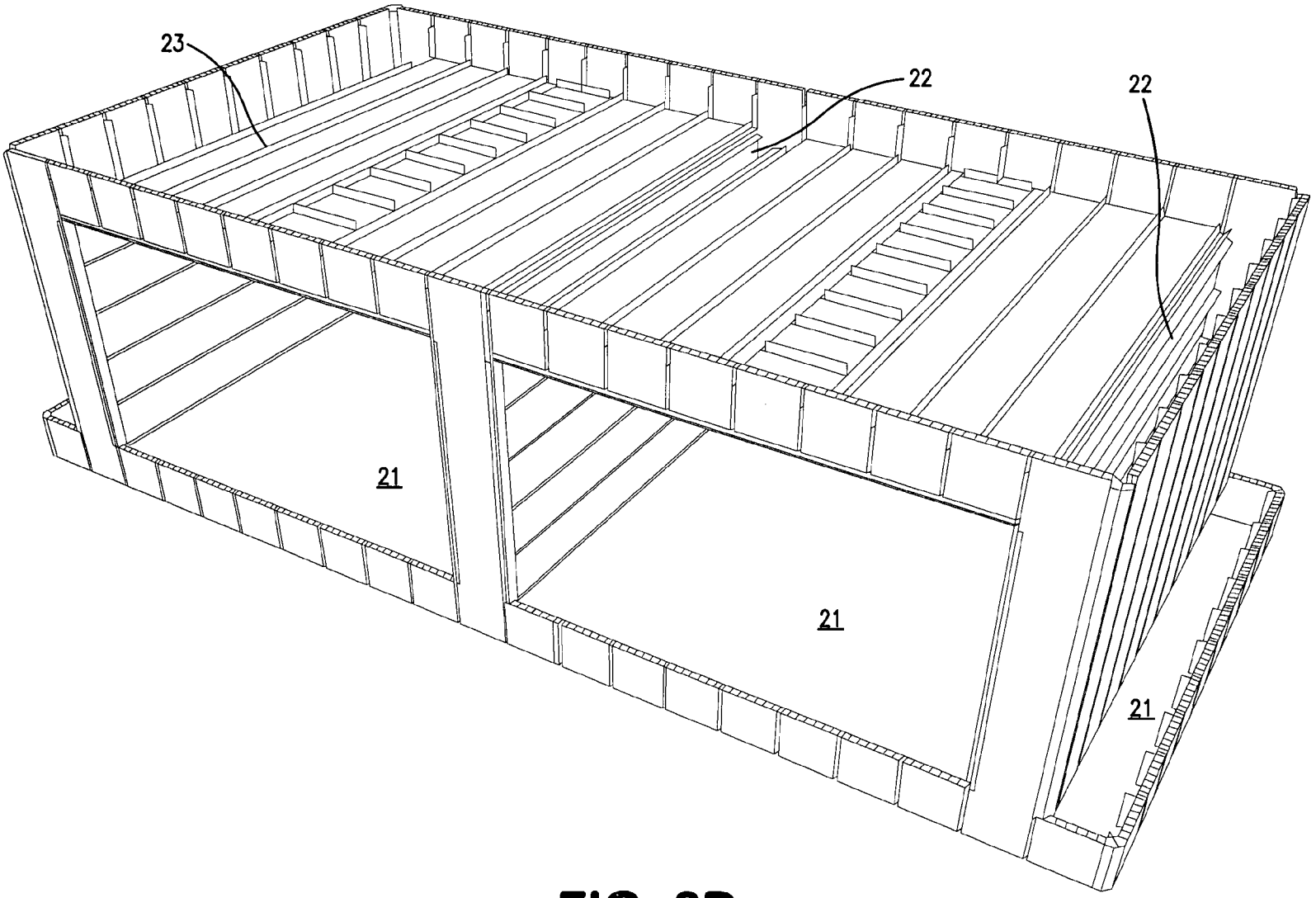
FIG. 6D is a perspective view of the encasement component for a two bay single unit segment of a modular steel-framed construction mold apparatus without the corresponding steel grillage component.

FIG. 6D shows the panelized encasement assembly component of a two bay single unit segment of a modular construction mold apparatus without the corresponding structural steel grillage component.

Figure 6E:
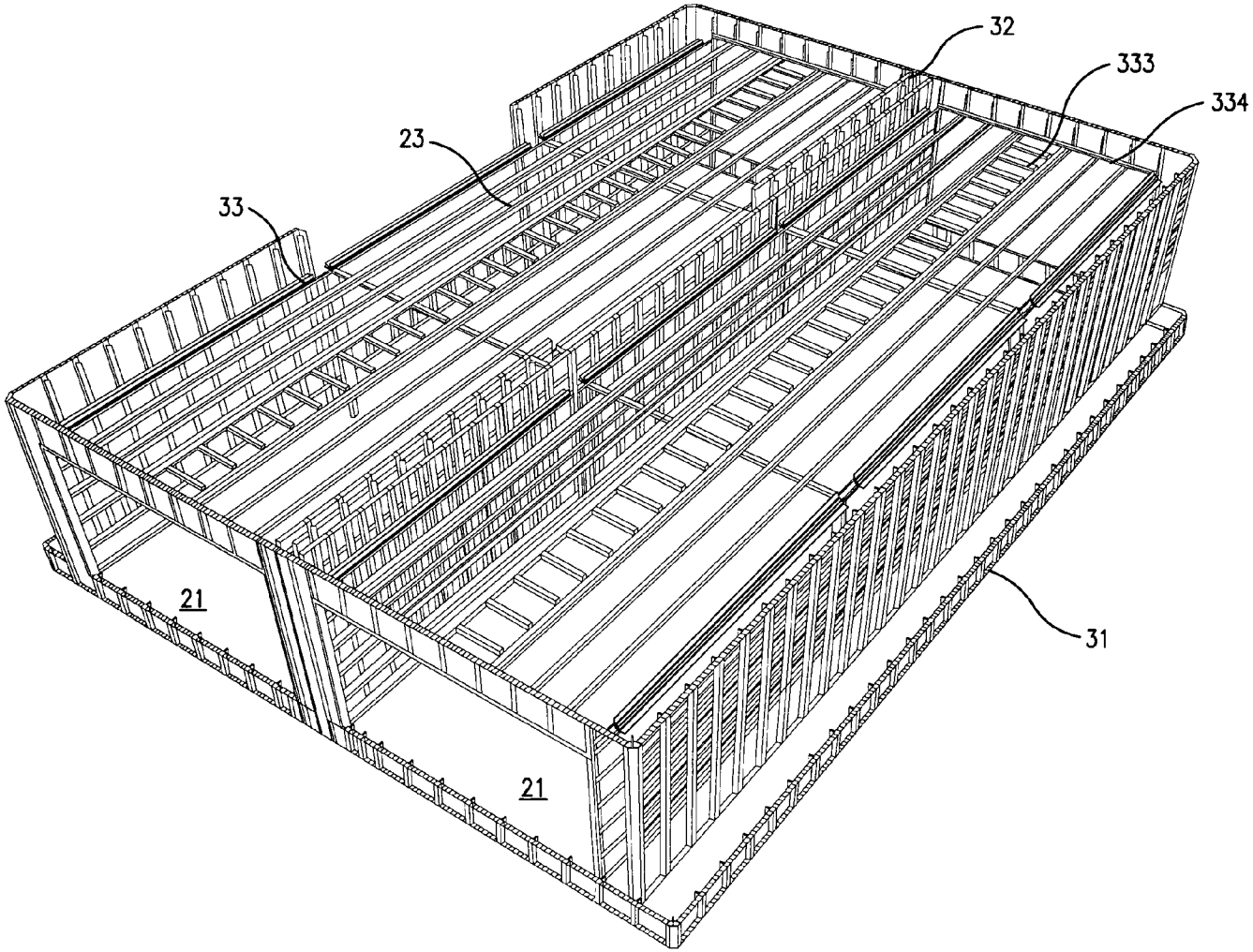
FIG. 6E is a perspective view of the encasement component for a two bay three unit segment of a modular steel-framed construction mold apparatus without the corresponding steel grillage component.
Figure 7:
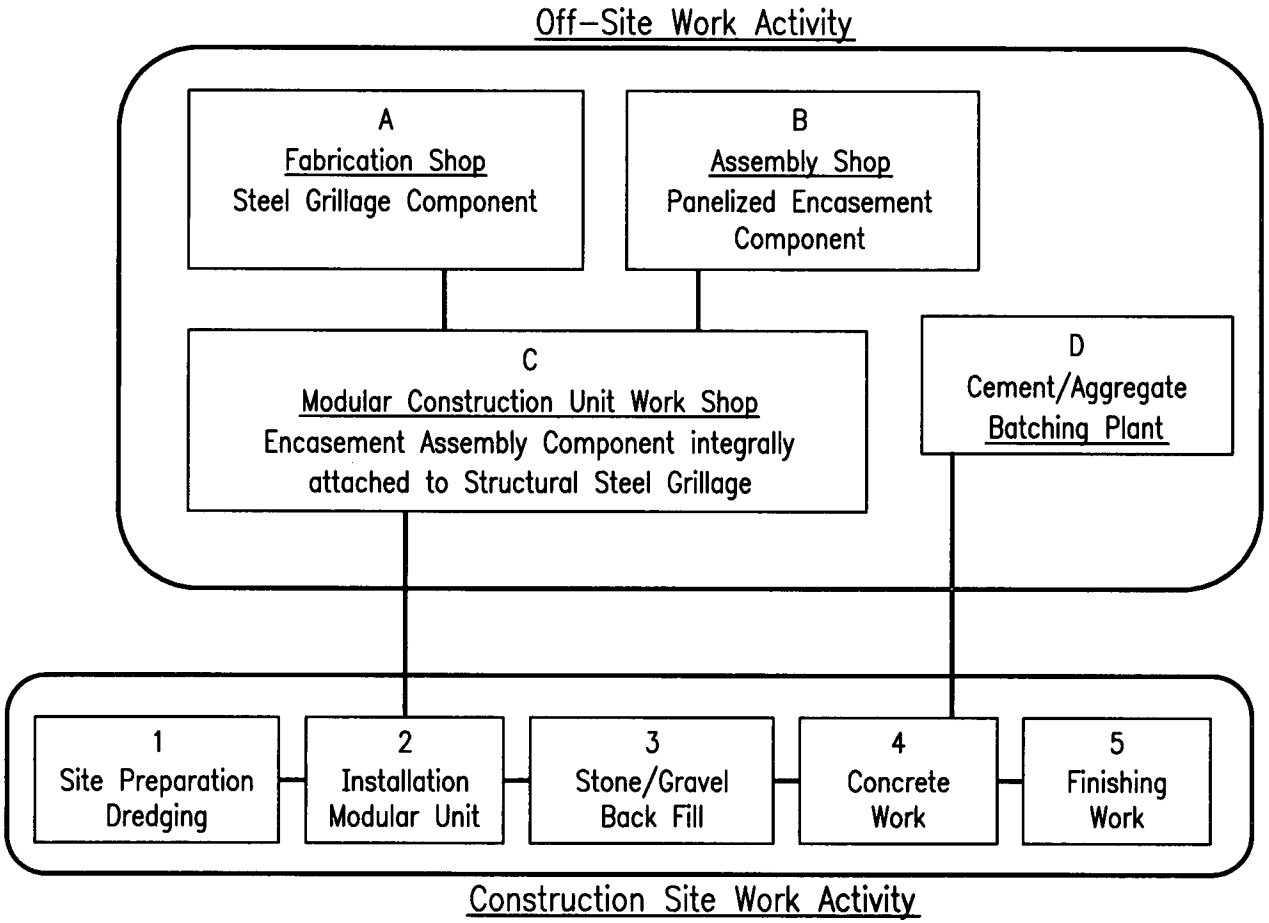
FIG. 7 is a flow chart identifying the steps involved in the preferred method for constructing permanently encased monolithic composite concrete and steel structures underwater using a modular steel-framed construction mold apparatus.

FIG. 6E shows a phantom view of a panelized encasement assembly component for a three unit two bay segment of a modular construction mold apparatus FIG. 7 shows a flow chart depicting the preferred method for constructing permanently encased monolithic composite concrete and steel structures in situ underwater comprising the off-site steps of:

A fabricating under controlled conditions structural steel grillage components for a modular custom-engineered steel-framed construction mold apparatus;

B integrally connecting encasement panels and connectors under controlled conditions into custom-engineered panelized encasement components corresponding to the steel grillage components fabricated in step A;

C integrally attaching said panelized encasement assembly components produced in step B to said steel grillage component fabricated in step A under controlled conditions to create modular steel-framed modular construction mold units;

D batching and mixing concrete fill under controlled conditions;

and construction site steps of:

1 site preparation work consisting of surveying, dredging out unsuitable material and backfilling stones or other suitable base materials;

2 transporting modular construction unit produced in step C site and installing said modular units by integrally joining grillage and encasement components of said unit to corresponding components of previously installed units to form a larger segment of the underwater steel-framed construction mold apparatus.

3 Placing stones or other suitable materials to support the concrete foundation slab;

4 Pumping and casting concrete fill into the structured void spaces of said modular mold apparatus to produce a permanently encased monolithic composite concrete and steel structure.

5 Finishing work which consists primarily of screeding concrete surfaces.

Steps A, B, C, and D, take place off site under controlled conditions. Steps 1, 2, 3, 4 and 5 take place on site underwater. The structural steel grillage component of the mold apparatus becomes fully embedded in the cast concrete. The panelized encasement component used to form and contain the wet concrete fill stays in place after the casting process is completed permanently protecting and insulating the submerged monolithic composite concrete and steel structure.

A similar reinforced concrete structure constructed underwater using conventional designs, materials, means and methods would involve ten or more on construction site work steps to complete, would take many months longer to construct, and cost many times more than the preferred methodology.

The present invention obviates the need to:

1) construct a cofferdam and temporary access and support facilities;

2) pump water from the cofferdam to create a dry work area;

3) use traditional incremental concrete construction methods;

4) erect conventional temporary formwork;

5) install conventional steel reinforcement rods;

6) remove the temporary formwork;

7) remove the cofferdam and other temporary support facilities.

As a consequence, said mold apparatus facilitates and accelerates concrete work under water, making underwater concrete construction a practical and economically viable alternative for creating durable and reliable structures that prevent flooding and coastal erosion, and other applications heretofore not considered viable due to cost considerations.

Figure 8:
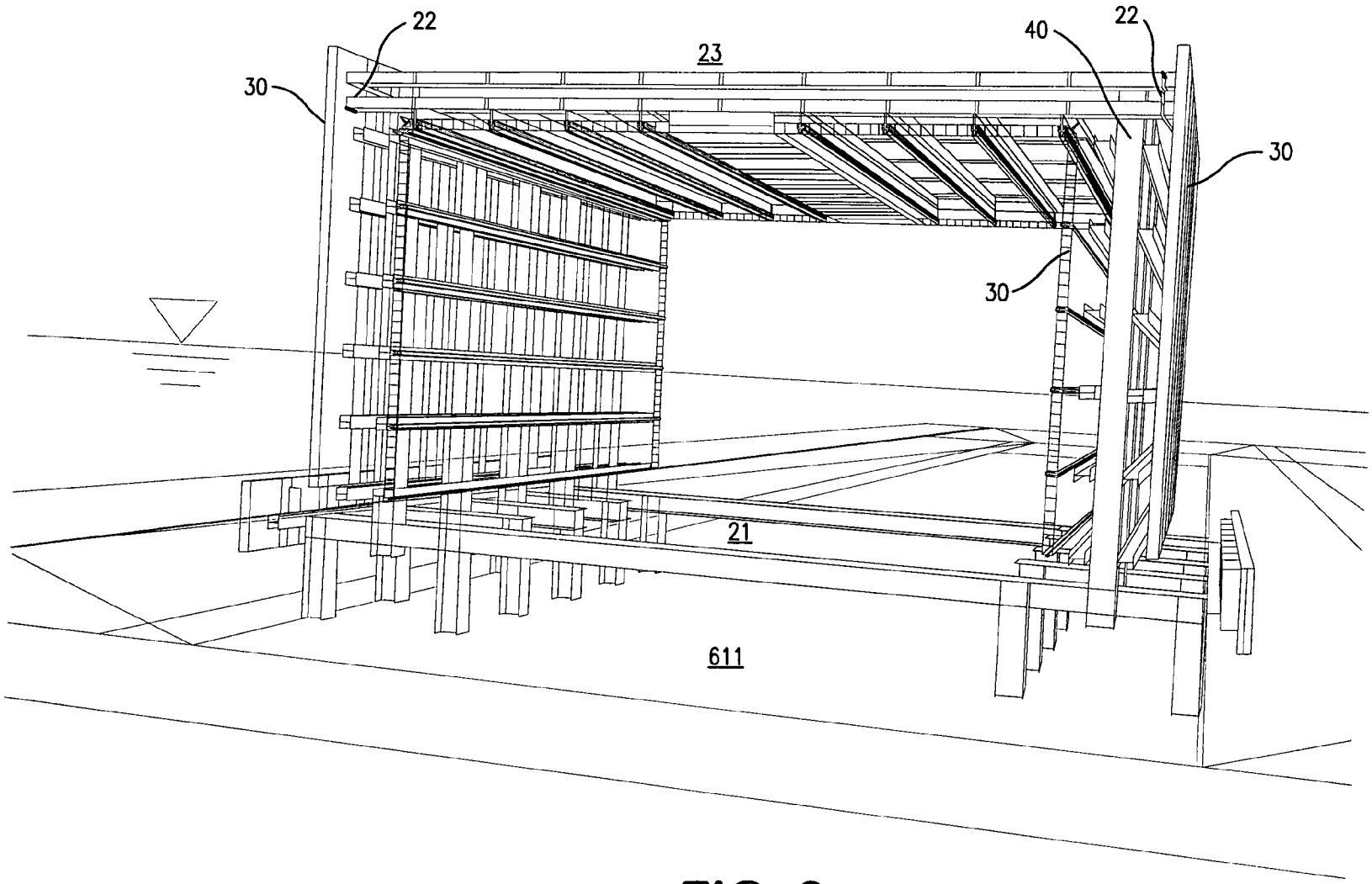
FIG. 8 is a perspective view of a partially submerged modular steel-framed construction mold apparatus in situ underwater prior to casting concrete fill.

FIG. 8 shows a phantom view of foundation 21, cavity wall 22, and roof deck 23 void spaces, and panelized encasement component 30 integrally attached to structural steel grillage 40 of a partially submerged steel-framed construction mold apparatus modular segment in situ in a dredged channel 611.

For review drawing reference numerals and items referenced are repeated here:

| REFERENCE CODES | |
|---|---|
| Modular Construction Mold Apparatus | 10 |
| Structured Void Spaces | 20 |
| Foundation | 21 |
| Cavity Walls | 22 |

-continued

| REFERENCE CODES | |
|---|---|
| Roof Deck | 23 |
| Panelized Encasement Component | 30 |
| Encasement Assemblies | |
| Foundation | 31 |
| Cavity Wall | 32 |
| Inside Face | 321 |
| Outside Face | 322 |
| Roof Deck | 33 |
| Center Section | 333 |
| Corner Section | 334 |
| Roof Deck End Wall | 34 |
| Foundation | 341 |
| Cavity Wall | 342 |
| Roof Deck | 343 |
| Encasement Elements | |
| Panels | 1, 17 |
| Panel Connector Bracket | 2 |
| Panel Connector with Keyway | 3 |
| Inside Corner Connector Bracket | 4 |
| Outside Corner Connector Bracket | 5 |
| Connector Cap | 6 |
| Structural Steel Grillage Component | 40 |
| Columns | 41 |
| Girders, Trusses, Joists | 42 |
| Base Beams | 43 |
| Girts | 44 |
| Outside | 441 |
| Inside | 442 |
| Purlins | 45 |
| Top | 451 |
| Bottom | 452 |
| Brackets | 46 |
| Pedestals | 47 |
| Bollards | 471 |
| Cross Beams | 472 |
| Girts | 473 |
| Construction Activities | 60 |
| Site Preparation | 61 |
| Dredged Area | 611 |
| Sub-base Back Fill | 612 |
| Module Fabrication & Mold Installation | 62 |
| Concrete Work | 63 |
| Foundation Concrete Fill | 631 |
| Side Wall Concrete Fill | 632 |
| Roof Slab Concrete Fill | 633 |

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A modular stay-in-place construction mold-apparatus for forming, casting and encasing horizontal concrete foundation, vertical walls and horizontal roof deck slab contiguous structural elements of monolithically constructed structures in situ on dry lands or underwater comprising:

a stay-in-place panelized encasement assembly comprising arrays of encasing panels, with adjacent longitudinal edges, forming a plurality of contiguous horizontal foundation, vertical wall and horizontal roof deck void spaces for accepting, containing and shaping wet concrete fill when cast into said void spaces, to form the said contiguous horizontal foundation, vertical wall and roof deck slab elements and a horizontal deck array of panels to further define the underside of the roof deck slab element, the panels being made of fiber reinforced polymer material, a stay-in-place structural steel grillage located within all said void spaces of said stay-in-place panelized encasement assembly and spaced from said panels of said encasement assembly, the grillage having a horizontal foundation portion, multiple vertical wall portions and a horizontal roof deck portion, the foundation portion and roof deck portions being integrally joined to the wall portions, first and second sets of panel connector brackets for tying panels of said panelized encasement assembly and said structural steel grillage together so that the grillage supports said encasement assembly, said brackets of said first set of brackets being made of fiber reinforced polymer material and being attached to said panels at adjacent longitudinal edges thereof and each of said first set of said bracket having a base portion for connecting a longitudinal edge of each such panel to a next adjacent panel, and also having extension arm portions extending from said base portions inward into said void spaces toward said structural steel grillage and wherein said second set of brackets are made of steel and are integrally attached to said structural steel grillage, and are also attached to said first set of brackets, said stay-in-place structural steel grillage and said second set of brackets being constructed and arranged in said spatial relation to said encasement assembly to become fully embedded in concrete fill during casting of concrete into said encasement assembly and wherein said panelized encasement assembly panels comprise keys at their longitudinal edges extending therefrom and brackets of said first set of brackets comprise keyways on one longitudinal edge of a base portion of a panel connector bracket configured to interlock and connect to a key formed along the corresponding longitudinal edge of a first stay-in-place encasement panel and a keyway on a second longitudinal edge of the base portion of said bracket configured to interlock with a key formed along the longitudinal edge of a second stay-in-place encasement panel and further comprising, U-shaped cap connectors with two parts of channel form, with each channel form part having two parallel opposing legs, with a first one of said channel form parts, sized and configured to fit over exposed ends of vertically oriented panels of said encasement assembly, and a second of said channel form parts configured to connect the upper butt end of said vertically oriented encasement panel assembly to the butt end of a second horizontally oriented roof deck encasement panel assembly intersecting at 90° to the longitudinal axis of said vertical panel assembly, with a key on said second channel form part of said cap connector interlocking and connecting to a panel connector bracket.

2. The apparatus of claim 1 wherein the encasement assembly comprises vertical wall panel arrays with respective ends of said arrays meeting at a 90° angle and, in one or more such instances, said first set of brackets further includes outside corner brackets that are between vertically aligned panels meeting at a 90° angle corner and each such outer corner bracket has (i) a base portion inserted between said panels attaching the panels to each other via a base portion of said corner bracket and also (ii) an arm extension into the cavity wall void space, and each of said outside corner brackets comprises:

(a) in cross-section a square-shaped tube as said outside corner bracket base portion with two keyways formed into adjoining sides of said tube base portion constituting the inboard corner of said tube, the openings of said keyways facing away from said tube on axes 90° to one another;

(b) said keyways configured to receive said keys protruding from edges of two interlocking and connecting ones of said encasement assembly wall panels meeting one another at 90° to form an assembly with said corner bracket;

(c) said corner bracket's arm extension being integrally formed into said inboard corner of said square-shaped tube base portion, and extending at 45° away from the plane of each of said panels meeting at said inboard corner, said bracket arm extensions being attached to a corresponding steel bracket of said second set of brackets integrally attached to said structural steel stay-in-place grillage component of said mold apparatus; and (d) an internal web wall integrally formed within the hollow space of each of said bracket base portion of said tubes dividing said space into two triangular-shaped interstices that extend the entire length of said outside corner bracket square-shaped tube form base portion.

3. A modular stay-in-place construction mold apparatus to enable the casting of concrete therein for forming, casting and encasing at least two connected modules of a structure, said mold apparatus comprising at least two mold modules, each module being as recited in claim 1, with at least two such modules being connected to each other, including connection of at least one encasement assembly to an encased assembly of an adjacent module and connection of the grillage of at least one module to the grillage of said adjacent module.

4. The apparatus of claim 1 wherein said roof deck horizontal stay-in-place encasement panel assemblies defining the underside of the horizontal roof deck void space are provided spanning the distance between spaced said arrays of said panelized encasement assembly that define separate vertical walls, said horizontal panel arrays comprising:

(a) two outer panel array sub-assembly sections connected together by a center section panel array sub-assembly said outer section and center section sub-assemblies comprised of a plurality of encasement panels with longitudinal edges and, connecting brackets between adjacent panels assemblies, (b) said longitudinal axes of said center section encasement panels being oriented 90° to the longitudinal axes of said outer sections encasement panels, and (c) and end cap connectors connecting said outer section sub-assemblies of said roof deck assembly to the center section sub-assembly thereof; and (d) said center section sub-assembly encasement panels array combined with said outer edge section sub-assembly encasement panels constitutes the roof span dimension between said panel array assemblies that define said vertical walls.

5. The apparatus of claim 1 wherein panels of arrays of vertical cavity void spaces meet at corners at the meeting ends in one or more instances, and further comprising inner corner connector bracket at each such corner, each of said inner corner brackets comprising:

(a) in cross-section a triangular-shaped tube of right-triangle form with keys extending away from the two angular walls of said tube that are at 90° to one another, for connecting with matching keyways portions recited below;

(b) a bracket arm integrally formed into and extending away from the hypotenuse base of said triangular-shaped tube at 90° into said void space (c) and further comprising connecting brackets at the ends of said meeting panel arrays aligned at 90° to one another and having keyways connecting to and interlocking with said keys extending away from said triangular-shaped tube.

6. A modular stay-in-place construction mold apparatus comprising:

(a) a stay-in-place panelized encasement assembly for shaping concrete poured therein and configured in contiguous horizontal foundation, vertical cavity wall and roof deck slab void space portions so that concrete poured therein and cured creates such foundation, walls and slabs, said panelized encasement assembly, (b) comprising arrays of hollow core fiber reinforced polymer panels with longitudinal edges, said edges having key extensions and (c) said assembly further comprising a first set of brackets of hollow core fiber reinforced plastic with keyways for attachment to said key extensions of said panels and said brackets also comprising extension arms extending into void space;

(d) a stay-in-place structural steel grillage located within said void spaces and spaced from said panels and further comprising a second set of brackets integrally attached to said grillage and to brackets of said first set; and (e) the structural steel grillage is within the encasement assembly and spaced from said stay-in-place panelized encasement assembly.

7. The apparatus of claim 6 wherein said hollow core panels of said encasement assemblies are formed in cross-section by two spaced apart exterior parallel planar polymer layers integrally connected by a plurality of spaced apart interior polymer ribs running between exterior layers: the spaced apart interior ribs of said hollow core panel form a plurality of interstices that exist along the entire longitudinal axis of the said panel.

8. A stay-in-place construction mold apparatus for forming, contiguous void spaces that define, horizontal foundation, vertical walls and horizontal roof deck slab elements of monolithically constructed structures in site on dry land or underwater comprising:

a stay-in-place panelized encasement assembly comprising one in a plurality of pairs of spaced opposing encasing arrays of panels forming each of said contiguous foundation void spaces, cavity wall void spaces and roof deck void spaces for accepting, containing and shaping wet concrete fill cast into said void spaces to form contiguous foundation, wall and deck portions, a stay-in-place structural steel grillage located within said horizontal and vertical void spaces of said stay-in-place panelized encasement assembly in such spatial relation to said encasement assembly as to become embedded fully in concrete when concrete is poured into said encasement assembly, and first and second sets of connecting means for tying panel arrays of said stay-in-place panelized encasement assembly to said stay-in-place structural steel grillage, said first set of connecting means comprising keyways attached to key extensions of said panelized encasement assembly and being located between edges of adjacent panels in said panel arrays and also extending inward in said void spaces formed between said spaced opposing panels toward said structural steel grillage therewithin and said second set of connecting means being attached to said grillage and also connected to said first set of connecting means;

said stay-in-place structural steel grillage and said stay-in-place panelized encasement assembly and said second set of connecting means being constructed and arranged to enable said stay-in-place grillage and said second set of connecting means to be within said void spaces to become-fully embedded in concrete fill during casting of concrete.

9. A stay-in-place construction mold apparatus for forming, contiguous void spaces that define, horizontal foundation, vertical walls and horizontal roof deck slab elements of monolithically constructed structures in situ on dry land or underwater comprising:

a stay-in-place panelized encasement assembly comprising one in a plurality of pairs of spaced opposing encasing arrays of panels forming each of said contiguous foundation void spaces, cavity wall void spaces and roof deck void spaces for accepting, containing and shaping wet concrete fill cast into said void spaces to form contiguous foundation, wall and deck portions, a stay-in-place structural grillage made of material selected from the group consisting of metals and fiber-reinforced polymer and located within said horizontal and vertical void spaces of said stay-in-place panelized encasement assembly in such spatial relation to said encasement assembly as to become embedded fully in concrete when concrete is poured into said encasement assembly, and first and second sets of connecting means for tying panel arrays of said stay-in-place panelized encasement assembly to said stay-in-place structural steel grillage, said first set of connecting means comprising keyways attached to key extensions of said panelized encasement assembly and being located between edges of adjacent panels in said panel arrays and also extending inward in said void spaces formed between said spaced opposing panels toward said structural grillage therewithin and said second set of connecting means being made of material selected from the group consisting of metals and fiber reinforced polymer and attached to said grillage and also connected to said first set of connecting means;

said stay-in-place structural steel grillage and said stay-in-place panelized encasement assembly and said second set of connecting means being constructed and arranged to enable said stay-in-place grillage and said second set of connecting means to be within said void spaces to become-fully embedded in concrete fill during casting of concrete.

10. A modular stay-in-place construction mold-apparatus for forming, casting and encasing horizontal concrete foundation, vertical walls and horizontal roof deck slab contiguous structural elements of monolithically constructed structures in situ on dry land or underwater comprising:

a stay-in-place panelized encasement assembly comprising arrays of encasing panels, with adjacent longitudinal edges, forming a plurality of contiguous horizontal foundation, vertical wall and horizontal roof deck void spaces for accepting, containing and shaping wet concrete fill cast into said void spaces to form said contiguous horizontal foundation, vertical wall and roof deck elements and a horizontal deck array of panels to form the underside of the roof deck slab element, the panels being made of fiber reinforced polymer material, a stay-in-place structural grillage comprising structural materials selected from the group consisting of metals and fiber reinforced polymer and located within said void spaces of said stay-in-place panelized encasement assembly and spaced from said panels of said encasement assembly, the grillage having a horizontal foundation portion, multiple vertical wall portions and a horizontal roof deck portion, the foundation portion and roof deck portions being integrally joined to the wall portions, first and second sets of panel connector brackets for tying panels of said panelized encasement assembly and said structural steel grillage together so that the grillage supports said encasement assembly, said brackets of said first set of brackets being made of fiber reinforced polymer material and being attached to said panels at adjacent longitudinal edges thereof and each bracket having a base portion for connecting a longitudinal edge of each said panel to a next adjacent panel, also having extension arm portions extending from said base portions inward into said void spaces toward said structural grillage and wherein said second set of brackets are made of structural materials selected from the group consisting of metals and fiber reinforced polymer and are integrally attached to said structural grillage, and also attached to said first set of brackets, said stay-in-place structural steel grillage and said second set of brackets being constructed and arranged in said spatial relation to said encasement assembly to become fully embedded in concrete fill during casting of concrete into said encasement assembly, and wherein said panelized encasement assembly panels comprise keys at the longitudinal edges extending therefrom and brackets of said first set of brackets comprise keyways on one longitudinal edge of a base portion of a panel connector bracket configured to interlock and connect to a key formed along the corresponding longitudinal edge of a first stay-in-place encasement panel and a keyway configured on a second longitudinal edge of the said bracket configured to interlock with a key formed along the longitudinal edge of the base portion of a second stay-in-place encasement panel, and further comprising, U-shaped cap connectors with two parts of dual channel form with each channel part forming part having two parallel opposing legs with a first one of said channel form parts sized and configured to fit over exposed ends of vertically oriented panels of said encasement assembly, and a second of said channel form parts configured to connect the upper butt end of said vertically oriented encasement panel assembly to the butt end of a second horizontally oriented roof deck encasement panel assembly intersecting at 90° to the longitudinal axis of said vertical panel assembly, with a key on said second channel form part of said cap connector slidably interlocking and connecting to said panel connector bracket.

* * * * *